US011549769B1

(12) United States Patent
Roth

(10) Patent No.: US 11,549,769 B1
(45) Date of Patent: Jan. 10, 2023

(54) SELF-LOCKING BOLT SYSTEM NOT REQUIRING AN EXTERNAL SURFACE TO LOCK TO

(71) Applicant: Mark John Roth, Appleton, WI (US)

(72) Inventor: Mark John Roth, Appleton, WI (US)

( * ) Notice: Subject to any disclaimer, the term of this patent is extended or adjusted under 35 U.S.C. 154(b) by 1 day.

(21) Appl. No.: 16/943,328

(22) Filed: Jul. 30, 2020

Related U.S. Application Data

(60) Provisional application No. 62/881,258, filed on Jul. 31, 2019.

(51) Int. Cl.
*F41A 5/12* (2006.01)
*F41A 3/16* (2006.01)
*F41A 3/56* (2006.01)

(52) U.S. Cl.
CPC *F41A 5/12* (2013.01); *F41A 3/16* (2013.01); *F41A 3/56* (2013.01)

(58) Field of Classification Search
CPC ..... F41A 5/12; F41A 3/16; F41A 3/56; F41A 3/12; F41A 3/14; F41A 3/26; F41A 3/28; F41A 3/30; F41A 3/34; F41A 3/54; F41A 3/38; F41A 3/40; F41A 3/44; F41A 3/46
USPC ..... 89/194
See application file for complete search history.

(56) References Cited

U.S. PATENT DOCUMENTS 2,424,264 A * 7/1947 Yorks ..... F41A 3/26 89/185
2,941,449 A * 6/1960 Reed ..... F41A 3/26 89/185
2,971,441 A * 2/1961 Reed ..... F41A 3/26 42/16
3,009,396 A * 11/1961 Dixon ..... F41A 9/30 89/187.01
4,416,186 A * 11/1983 Sullivan ..... F41A 3/66 89/198
4,579,034 A * 4/1986 Holloway ..... F41A 17/38 D22/103
2009/0019754 A1* 1/2009 Moretti ..... F41A 15/14 42/69.02

(Continued)

OTHER PUBLICATIONS

CMMG, Inc., 22LR AR Conversion Kit, Bravo, LH, BLK as viewed on Jul. 8, 2021 at https://cmmg.com/22lr-ar-conversion-kit-bravo-lh-blk, date of product unknown but the style of the product is believed to have been in existence before the earliest priority date of the application. 1 page.

*Primary Examiner* — John Cooper
(74) *Attorney, Agent, or Firm* — Brannen Law Office, LLC

(57) ABSTRACT

A self-locking bolt assembly is provided having a short stroke allowing the assembly to be contained within the receiver. The assembly has a base plate, a recoil rod with a spring, a bolt body, a bolt and a locking mechanism. The bolt is internally (i.e. lockable onto itself) lockable when the bolt is in battery. The locking mechanism, for example, can be a roller bearing, a lever lock, a cam rotary lock or a roller. The locking mechanism engages to recoil rod and prevents rearward motion of the bolt. Blowback and reciprocation of the bolt are temporarily delayed after a shot is fired until after the bolt is unlocked. Rearward movement of the bolt body due to inertia causes the locking mechanism to be disengaged to unlock the bolt and to allow for reciprocation of the bolt.

10 Claims, 43 Drawing Sheets

(56) References Cited

U.S. PATENT DOCUMENTS

| | | | | |
|---|---|---|---|---|
| 2014/0059910 | A1* | 3/2014 | Norton | F41A 3/00 42/9 |
| 2014/0331853 | A1* | 11/2014 | St. George | F41C 7/00 42/16 |
| 2018/0142972 | A1* | 5/2018 | Overstreet | F41A 19/30 |

* cited by examiner

SELF-LOCKING BOLT SYSTEM NOT REQUIRING AN EXTERNAL SURFACE TO LOCK TO

This United States utility patent application claims priority on and the benefit of provisional application 62/881,258 filed Jul. 31, 2019, the entire contents of which are hereby incorporated herein by reference.

BACKGROUND OF THE INVENTION

1. Field of the Invention

The present invention relates to a self-locking bolt system that does not require an external surface to lock to and that is useful with firearms to delay blowback.

2. Description of the Related Art

An AR-15 firearm, or simply AR-15, is a very popular firearm model. The AR-15 was developed at least in part to overcome some drawbacks associated with then existing semi-automatic firearms. One drawback was the relative complexity of existing semi-automatic firearms. In particular, there are often many moving parts above and/or below the barrel axis. The inertia of these moving components can greatly reduce the smoothness, and therefore the accuracy, of the firearms due to internal imbalances. The AR-15 overcomes this issue effectively. Yet, the AR-15 itself can be improved upon.

The AR-15 relies on a relatively large discharge pressures to cause the action to reciprocate. In order to accomplish this, a large and heavy recoil spring and bolt are used. These two components alone contribute significantly to the weight and recoil of the AR-15. Further, it is impractical to attempt to minimize the size and weight of these components and the components are designed to accommodate the pressures developed when firing traditional caliber bullets.

Further, a buttstock is required for use with traditional AR-15 rifles since the recoil spring extends into the buttstock. Given this space requirement, a buttstock is mandatory in a traditional AR-15 and cannot be folded out of the way.

Another limitation of the traditional AR-15 is that in order to manage the forces of the explosion, the bolt rotates and locks to the barrel extension when a cartridge is chambered. Then, due to inertia, the bolt body, through a cam, unlocks the bolt from the barrel extension (other external location) so that the bolt can reciprocate in order to cycle to the next shot.

Traditional AR-15 rifles further can have high maintenance requirements.

Relatively recently, there has been a trend towards pistol caliber carbines. These firearms operate with significantly less pressure and therefore require alternative or modified bolt systems. While some designs exist, none show the present invention.

Thus, there exists a need for a self-locking bolt system that solves these and other problems.

SUMMARY OF THE INVENTION

A self-locking bolt assembly is provided having a short stroke allowing the assembly to be contained within the receiver. The assembly has a base plate, a recoil rod with a spring, a bolt body, a bolt and a locking mechanism. The assembly is internally lockable (i.e. lockable onto itself) when the bolt is in battery. The locking mechanism, for example, can be a roller bearing, a lever lock, a cam rotary lock or a roller. The locking mechanism engages to recoil rod and prevents rearward motion of the bolt. Blowback and reciprocation of the bolt are temporarily delayed after a shot is fired until after the bolt is unlocked. Rearward movement of the bolt body due to inertia causes the locking mechanism to be disengaged to unlock the bolt and to allow for reciprocation of the bolt.

The delaying of the blowback is advantageous because pressure is reduced to a safe level before the blowback, unlocking and reciprocation occurs.

According to one advantage of the present invention, the locking assembly is an internally locking assembly that does not require an external surface (i.e. external relative to the assembly) for the bolt to lock to. This is advantageous for several reasons, one of which is that its operation is independent of external support structures. Another reason is that there are no compatibility issues with use of the present invention as any sizing, wear, damage or other particular issues with external support structures is moot. In one embodiment, the locking occurs when the bolt forces roller bearings into engagement with reliefs in recoil rods. In another embodiment, the locking occurs as a bolt forces a lock lever into engagement with a recoil rod. In a further embodiment, a cam rotary lock engages a rod to lock the bolt in a locked position. In a further embodiment, a roller engages a channel in a rod to lock the bolt in a locked position. In each embodiment, the locked bolt results in a delayed blowback.

According to another advantage of the present invention, the assembly is a short stroke assembly allowing the assembly to be completely received within the receiver. This advantageously allows the buttstock to be a truly optional firearm component since no part of the present invention extends into the buttstock.

Further, the assembly can be used without making any permanent firearm modifications.

According to a further advantage of the present invention, the locked bolt results in a delayed blowback of the explosion gasses. This is because, as initial detonation is occurring, the bolt remains in a locked position in relation to (but not fixed directly to) the barrel. Then, as inertia carries the bolt body rearward, the lock unlocks and the bolt and bolt body can both reciprocate within the receiver.

According to a still further advantage of the present invention, the heavier the charge, the more secure the lock. The explosion during firing produces pressure, which acts both against the bullet and against front of the bolt. The pressure behind the bullet expels the bullet from the firearm at a high velocity. The pressure against the bolt holds the lock in the locked position. The greater the pressure, the greater the force upon the lock to maintain the locked position.

According to a still further advantage yet of the present invention, the lock automatically unlocks as the bolt body moves rearward due to inertia thereby self-regulating the reciprocation of the bolt. In one embodiment, the roller bearings fall out of reliefs and move in pockets. In another embodiment, a pin moves in a slot in the lock lever causing it to rotate and disengage from the rod. In a further embodiment, the cam rotary lock rotates as a cam pin moves in an angled slot causing the cam rotary lock to disengage from a rod relief. In a further embodiment, the rollers are moved out of channels as they move in slots in the bolt body.

According to a still further advantage yet of the present invention, the replacement of the normal bolt and recoil spring with the present invention results in a significant weight savings. Advantageously, a reduction in weight is associated with an increase in firearm comfort and maneuverability.

Further, because of the locking system and a reduction in weight, particularly of the mass movement of the moving components, reduces felt recoil.

According to a still further advantage yet of the present invention, it is easy disassembled for cleaning and maintenance.

According to a still further advantage yet of the present invention, the invention can be used as a drop in part for current AR style blowback 9 mm systems.

Other advantages, benefits, and features of the present invention will become apparent to those skilled in the art upon reading the detailed description of the invention and studying the drawings.

DETAILED DESCRIPTION OF PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
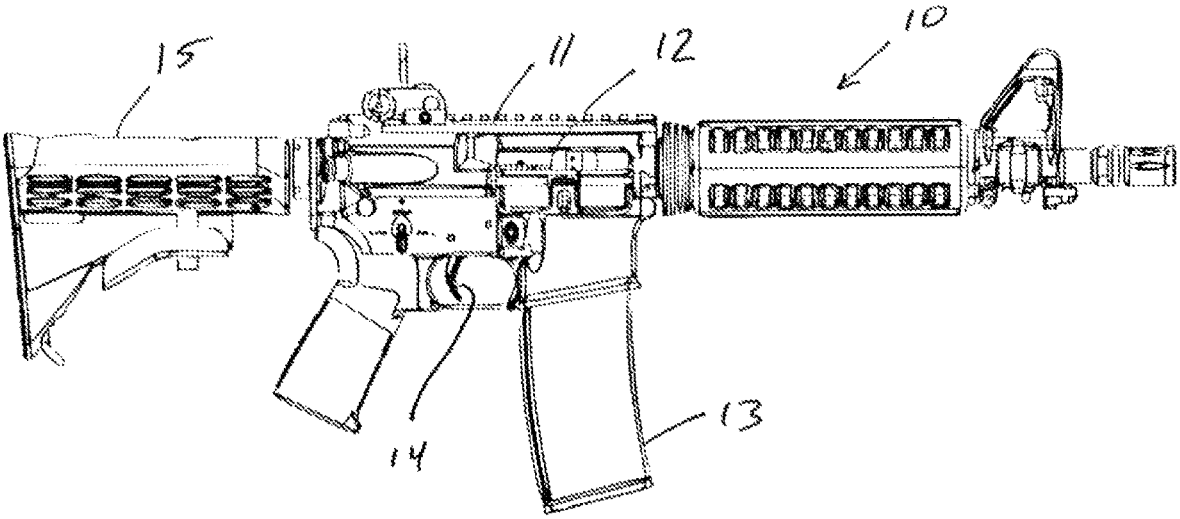
FIG. 1 is a is side view of an AR-15.

The present invention is useful with many styles of firearms, including but not limited to the AR-15 9 mm conversions. Another example of a suitable platform is JP Enterprises AR-9 mm. An exemplary AR-15 is illustrated in FIG. 1. The firearm 10 has a receiver 11 with an ejection port 12. A magazine 13 is removably attached to the receiver 11. A trigger 14 is provided and is used to fire the firearm 10. A buttstock 15 is also illustrated. The upper receiver has a standard profile that is round with a notch formed in the top shaped to receive a key. The lower receiver has a round profile without a notch. When the upper receiver is mated with the lower receiver, at item received within the upper receiver notch will abut the lower receiver (without a notch) instead of allowing rearward movement.

One embodiment of an assembly 20 the present invention is illustrated in FIGS. 2-30. The assembly 20 replaces a bolt and recoil spring of traditional firearms. The assembly 20 has a base plate 30, a top recoil rod 40, two recoil rods 50 and 60, respectively, a bolt body 70, roller bearings 90 and 95, a bolt 100, an extractor 120, a cam pin 130, a firing pin 140 and a cotter pin 150. Each of these components is described below.

The base plate 30 can be best seen in FIGS. 5, 6 10-17 and 24. Base plate 30 has a hole 31 for receiving the recoil rod 40. Base plate 30 further has a hole 32 for receiving recoil rod 50 and a hole 33 for receiving recoil rod 60. Holes 31, 32 and 33 do not pass entirely through the base plate 30. In this regard, the rods 40, 50 and 60 are stationarily held within the base plate 30. The base plate preferably has a round outer diameter and a key tab 35 that allows it to fit into the upper receiver, but not allowed to travel into the lower receiver buffer tube as it is a round shape only.

The top rod 40 can be best seen in FIGS. 5, 6 10-17 and 24. Recoil rod 40 has an end 41 and an end 42. A head 45 is at end 42. The head 45 has a larger diameter than the body of the rod 40. End 41 is received within hole 31 of the base plate 30. A spring 49 is around the perimeter of the rod 40.

The recoil rod 50 can be best seen in FIGS. 5, 6 and 10-26. Recoil rod 50 has an end 51 and an end 52. A relief 55 is formed in the rod between the ends. The relief 55 has the shape produced by revolving a hemi-sphere about the rod axis so that the relief 55 can receive a ball. End 51 is received within hole 32 of the base plate 30. A spring 59 is around the perimeter of the rod 50.

The recoil rod 60 can be best seen in FIGS. 5, 6 and 10-26. Recoil rod 60 has an end 61 and an end 62. A relief 65 is formed in the rod between the ends. The relief 65 has the shape produced by revolving a hemi-sphere about the rod axis so that the relief 65 can receive a ball. End 61 is received within hole 33 of the base plate 30. A spring 69 is around the perimeter of the rod 60.

Top rod 40 has a recoil rod axis. Recoil rod 50 has a recoil rod axis. Recoil rod 60 has a recoil rod axis. It is appreciated that all of the recoil rods are oriented parallel to each other.

It is appreciated that while three recoil rods are illustrated, that there could be more or fewer recoil rods without departing from the broad aspects of the present invention. It is also appreciated that each rod does not need to have a spring around it. It is further appreciated that a recoil spring does not need to surround a rod.

The bolt body 70 is best seen in FIGS. 5-17 and 29-30. Bolt body 70 has an end 71 and an end 72. The bolt body 70 has several holes for receiving other components, including recoil hole 75, recoil rod hole 76, recoil rod hole 77, bolt hole 78, cam pin hole 82, firing pin hole 83 and cotter pin hole 84. The bolt hole 78 has a lip 79. The bolt body 70 further has two internal pockets 80 and 81, respectively.

The recoil hole 75 movably receives end 42 of the recoil rod 40. The head 42 prevents the bolt body 70 from forwardly escaping the recoil rod 40. The spring 49 is between the base plate 30 and the bolt body 70. The spring 49 biases the bolt body away from the base plate 30 and compresses when the bolt body 70 moves towards the base plate 30.

The recoil rod hole 76 movably receives the end 52 of the recoil rod 50. Spring 59 is between the base plate 30 and the bolt body 70. The spring 59 biases the bolt body away from the base plate 30 and compresses when the bolt body 70 moves towards the base plate 30.

The recoil rod hole 77 movably receives the end 62 of the recoil rod 60. Spring 69 is between the base plate 30 and the bolt body 70. The spring 69 biases the bolt body away from the base plate 30 and compresses when the bolt body 70 moves towards the base plate 30.

A roller bearing 90 is movable within pocket 80. A roller bearing 95 is movable within pocket 81. The pocket 80 is aligned with relief 55 and the pocket 81 is aligned with relief 65 when the bolt body is in the forward most state wherein the bolt body 70 abuts the head 45 of the recoil rod 40.

The bolt 100 is best seen in FIGS. 5-7, 10, 18, 20, 22 and 25-28. The bolt 100 has a first end 101 and a second end 102. The bolt 100 has an extractor pocket 105 for receiving an extractor 120. The bolt 100 has a cam pin pocket 106 for receiving a cam pin 130. The bolt 100 further has a firing pin hole 107 through which a firing pin 140 is operable.

Figure 8:
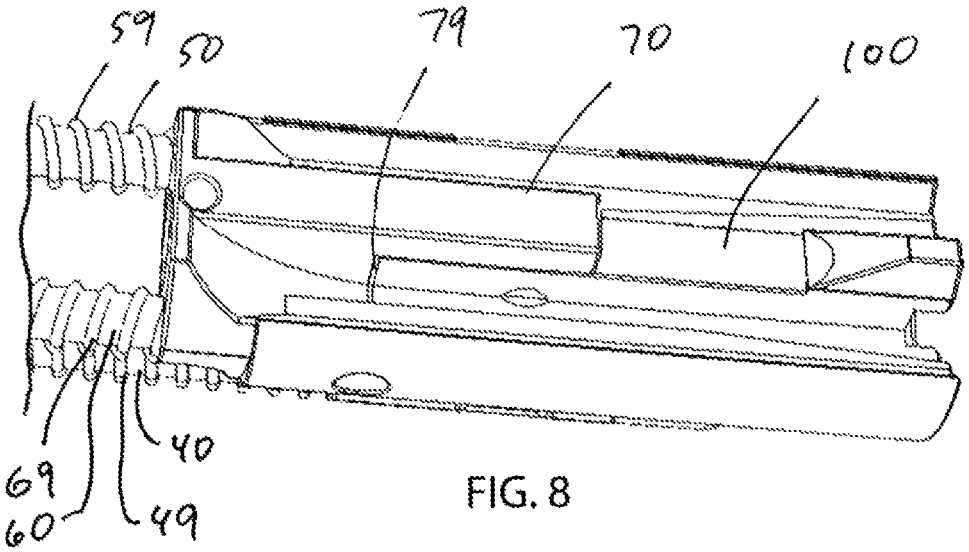
FIG. 8 is a close-up view showing the bolt and bolt body.
Figure 9:
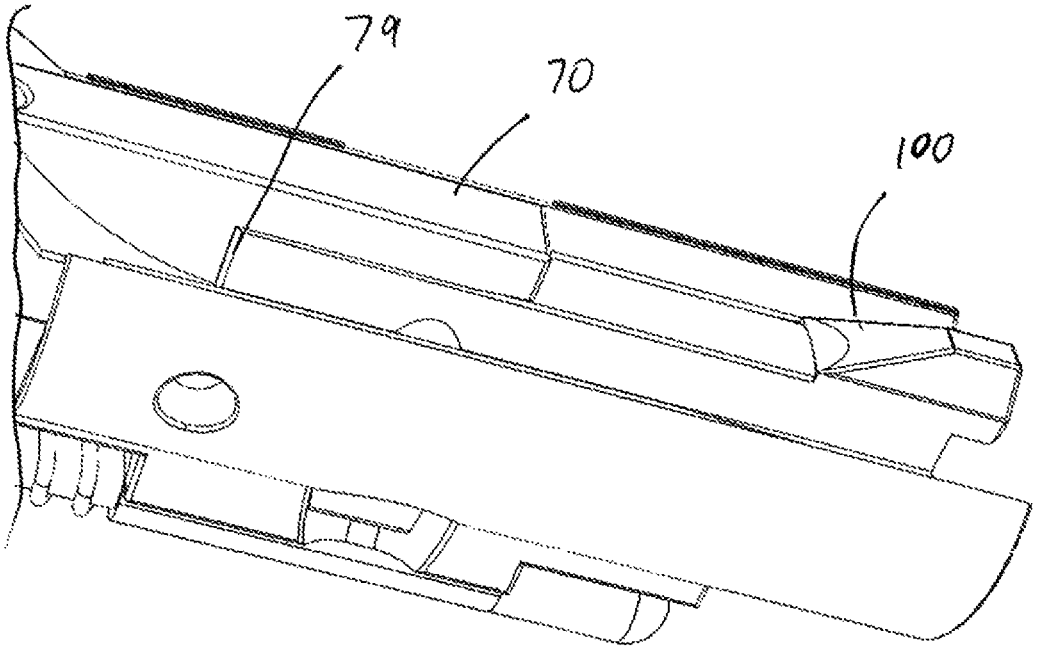
FIG. 9 is a close-up view showing the bolt and bolt body illustrated in a locked position.
Figure 10:
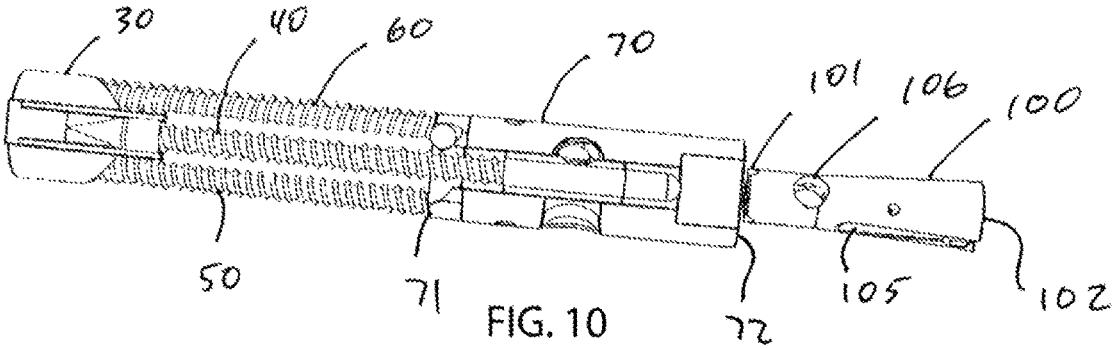
FIG. 10 is a top view showing the bolt adjacent the bolt body in a disassembled state.
Figure 11:
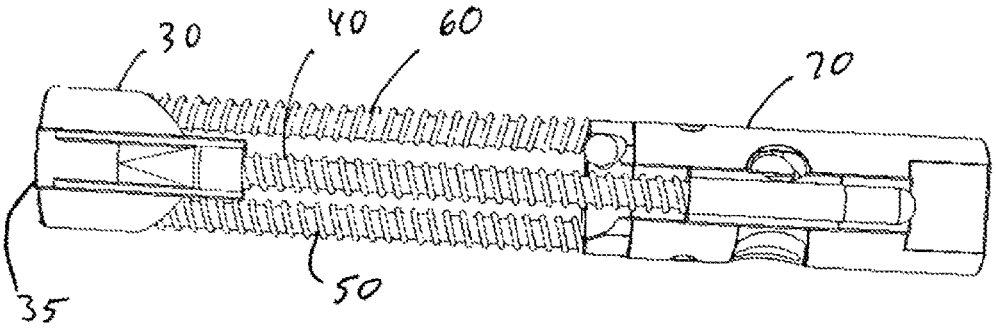
FIG. 11 is similar to FIG. 10 but shows the bolt received within the bolt body.
Figure 12:
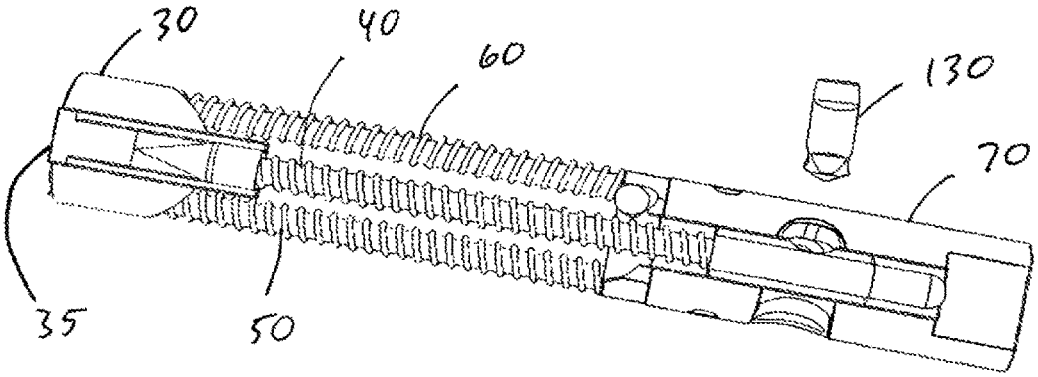
FIG. 12 shows a cam pin adjacent the bolt body.
Figure 13:
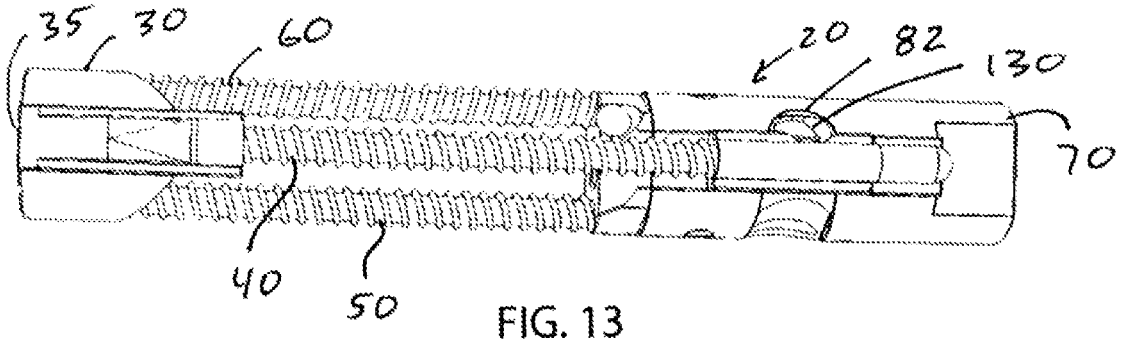
FIG. 13 shows the cam pin received within the cam pin hole in the bolt body.
Figure 14:
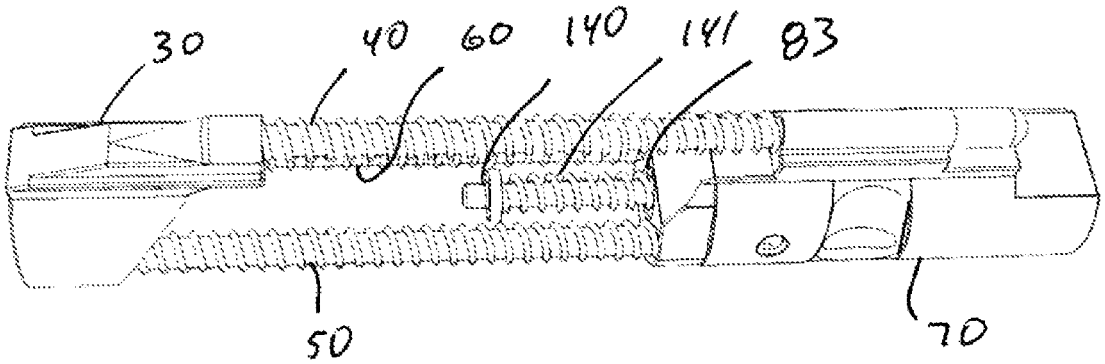
FIG. 14 shows the firing pin being inserted into the bolt.
Figure 15:
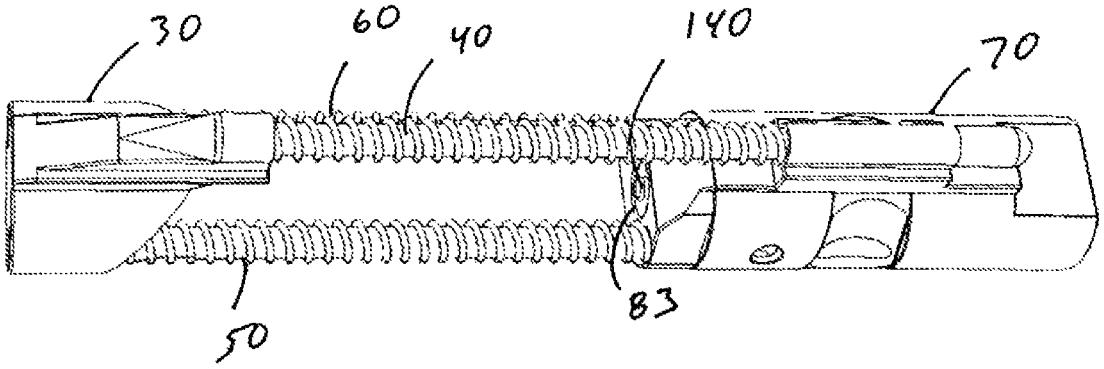
FIG. 15 shows the firing pin fully inserted into the bolt.
Figure 16:
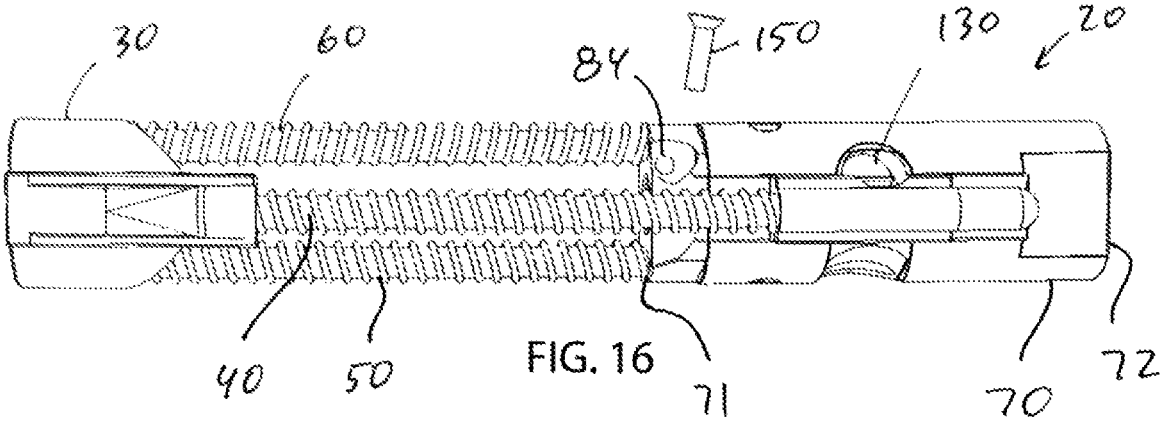
FIG. 16 shows a cotter pin adjacent the bolt body.
Figure 17:
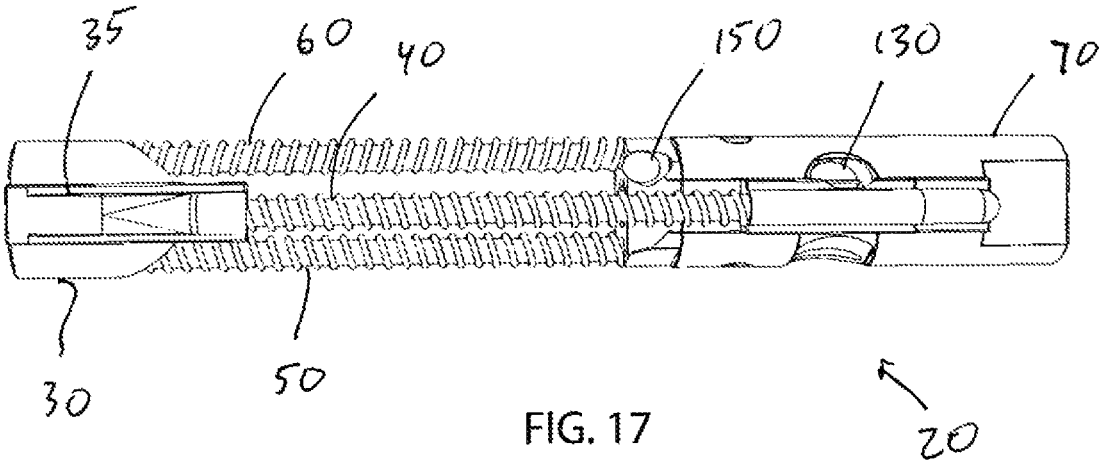
FIG. 17 shows the cotter pin received within the cotter pin hole of the bolt body.
Figure 18:
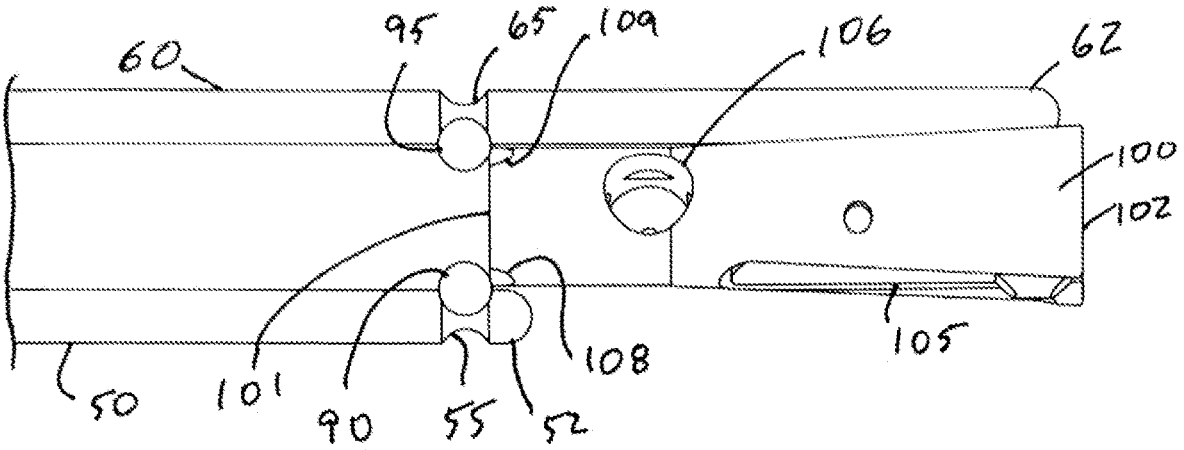
FIG. 18 shows the bolt, two recoil rods and two roller bearings, the roller bearings being in an unlocked position.
Figure 19:
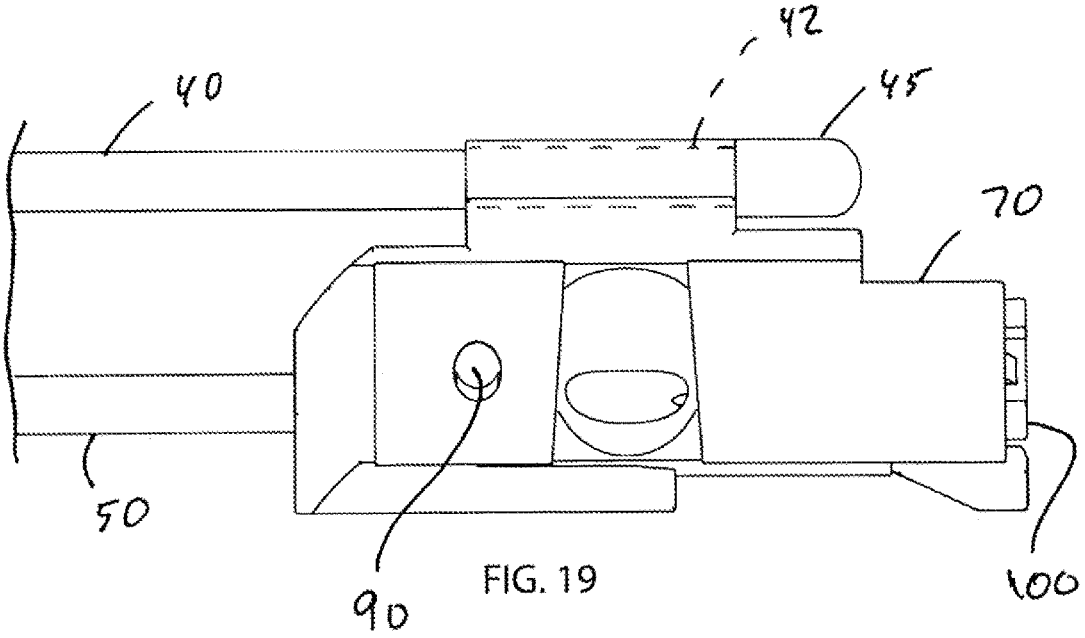
FIG. 19 is similar to FIG. 18 but additionally shows the bolt body.
Figure 20:
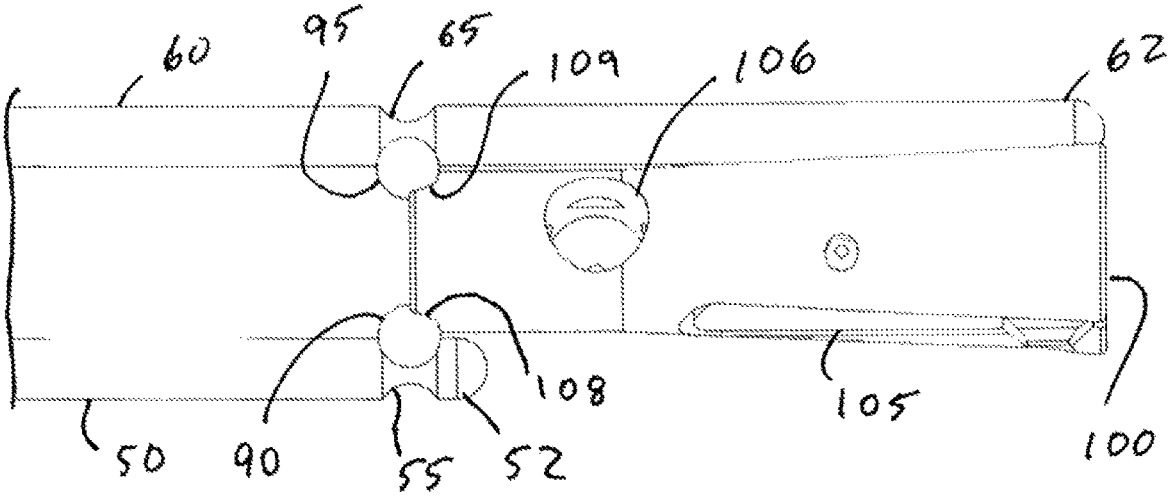
FIG. 20 shows the bolt, two recoil rods and two roller bearings, the roller bearings being in a locked position.
Figure 21:
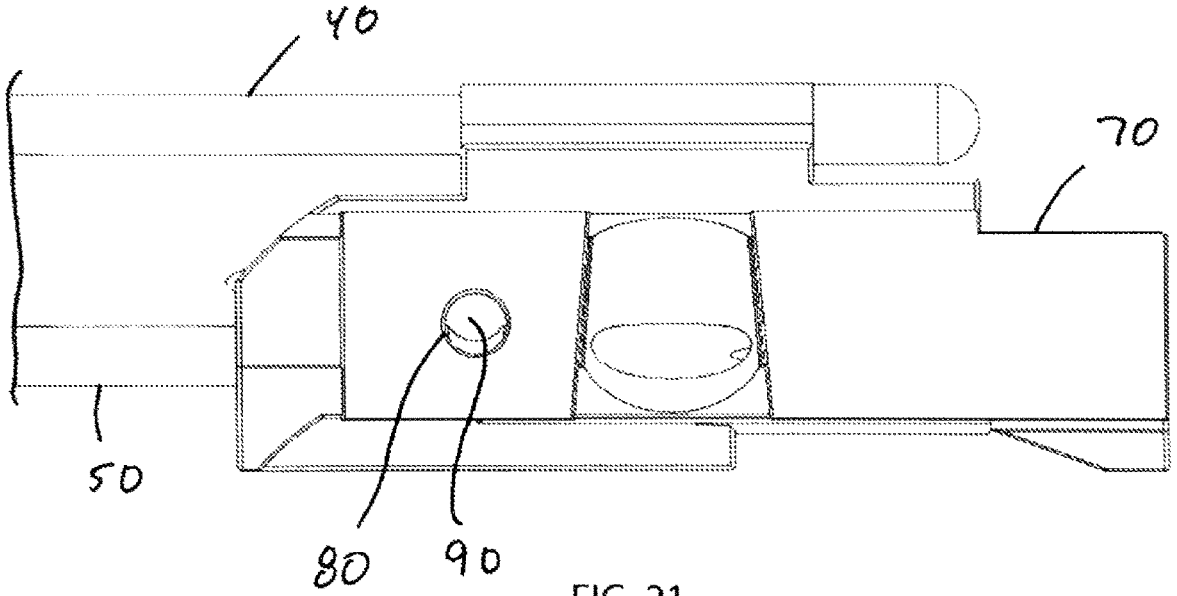
FIG. 21 is similar to FIG. 20 but additionally shows the bolt body.
Figure 22:
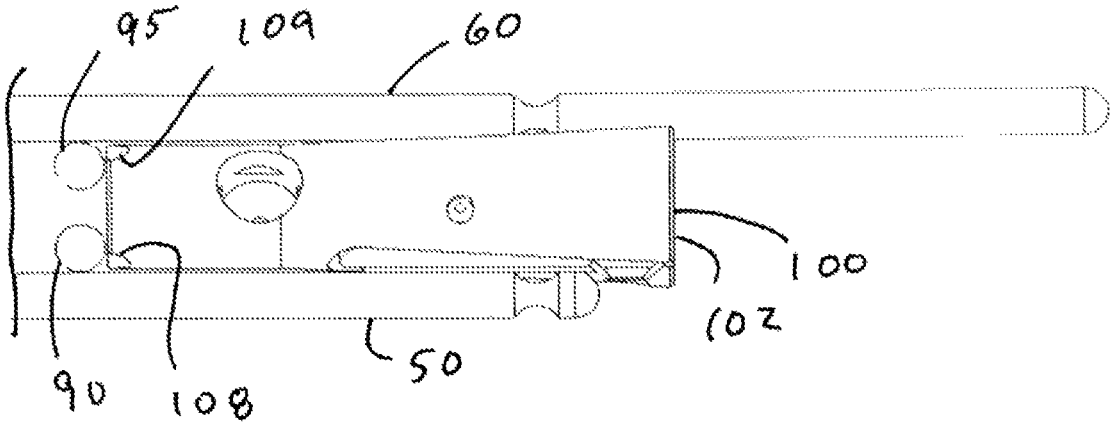
FIG. 22 shows the bolt, two recoil rods and two roller bearings, the roller bearings being in a fully reciprocated position.
Figure 23:
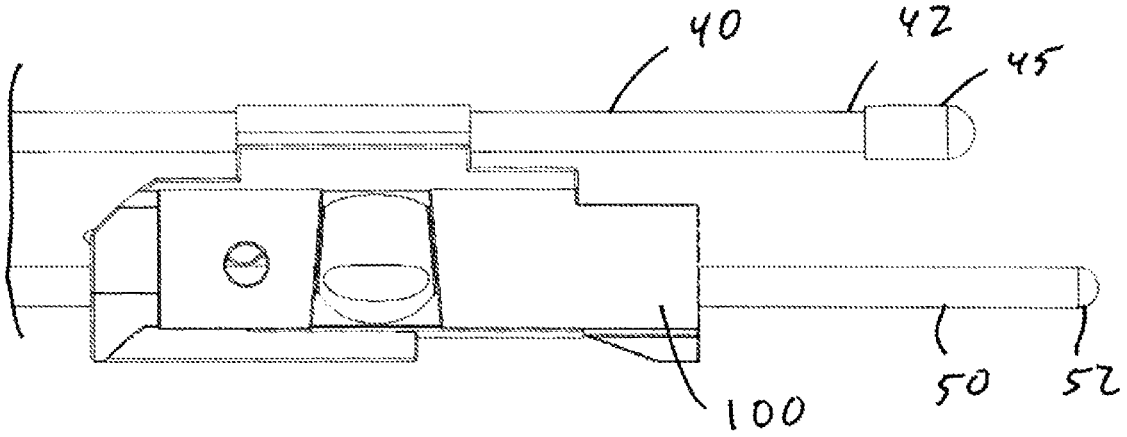
FIG. 23 is similar to FIG. 22 but additionally shows the bolt body.
Figure 24:
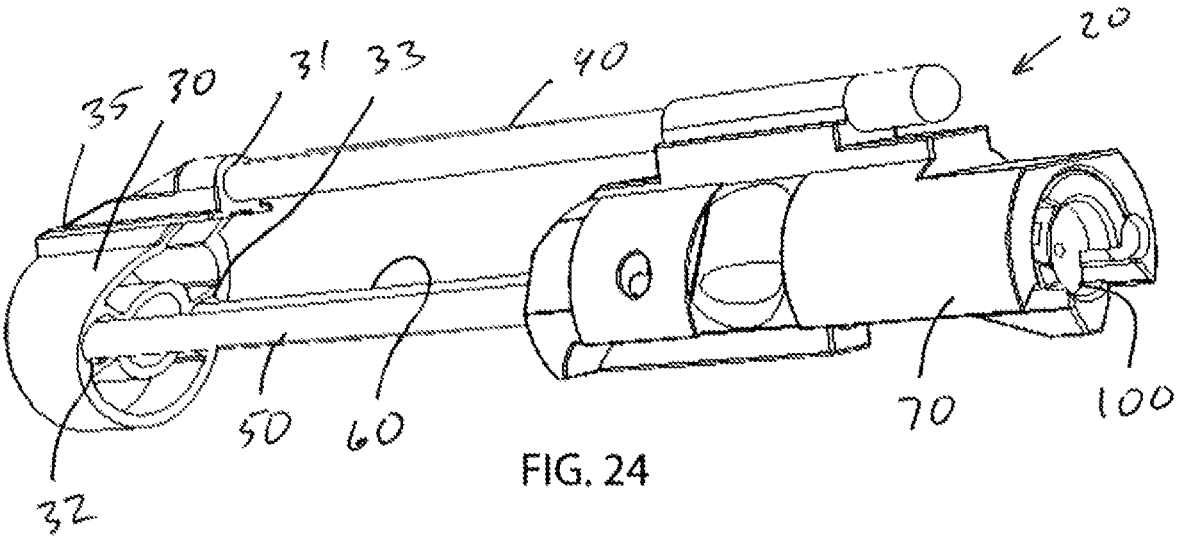
FIG. 24 is a perspective view of the assembly.
Figure 25:
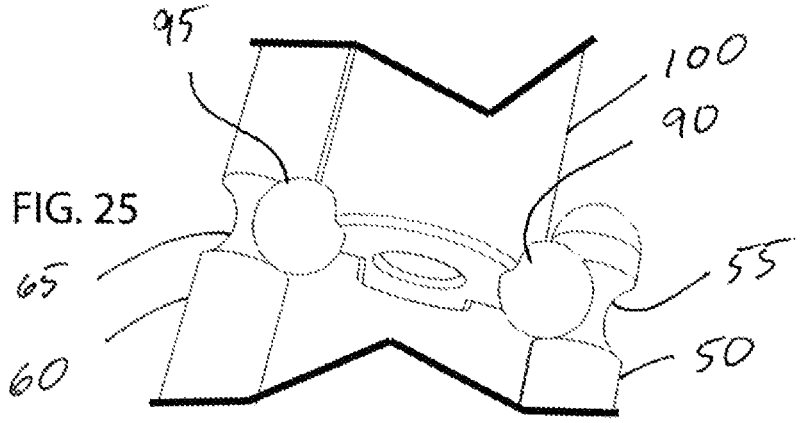
FIG. 25 is a close-up view showing the roller bearings in the locked position.
Figure 26:
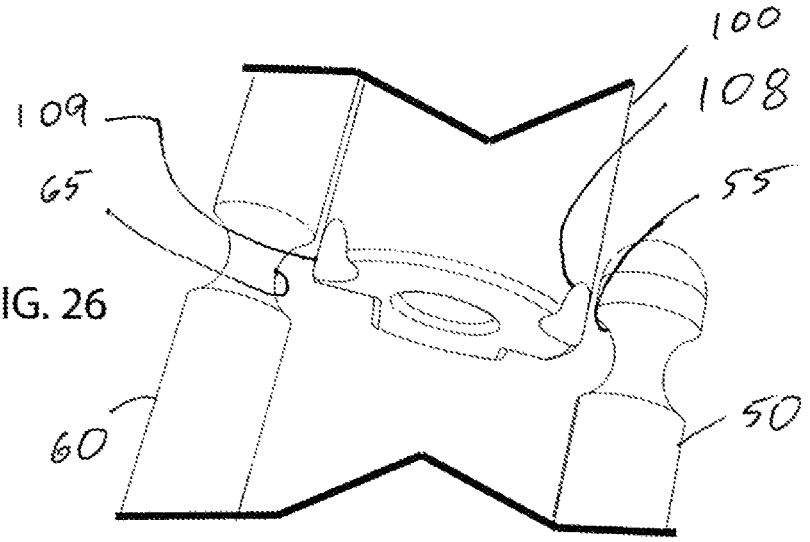
FIG. 26 is similar to FIG. 25 but is illustrated without the roller bearings.
Figure 27:
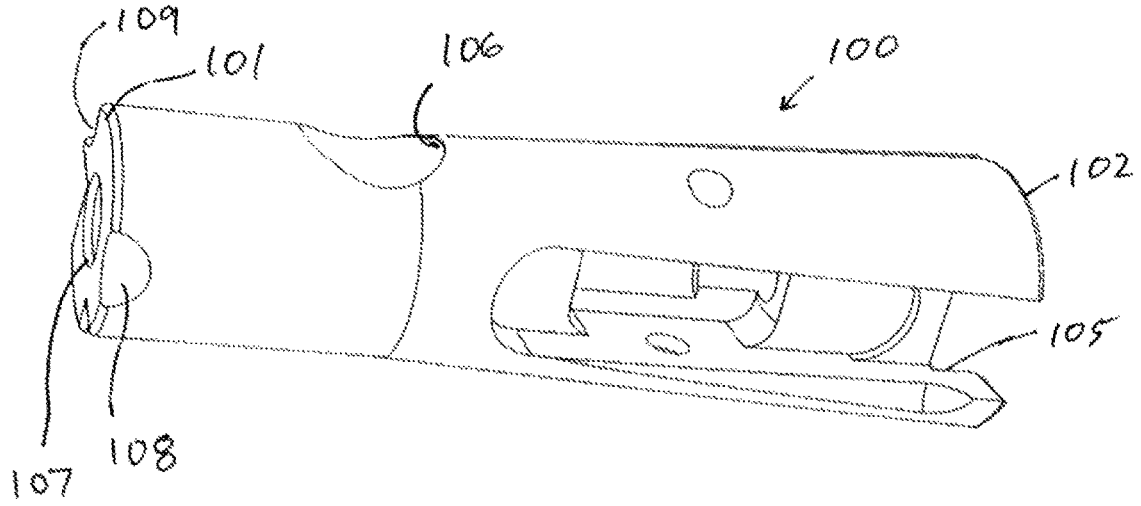
FIG. 27 is a perspective view of the bolt.
Figure 28:
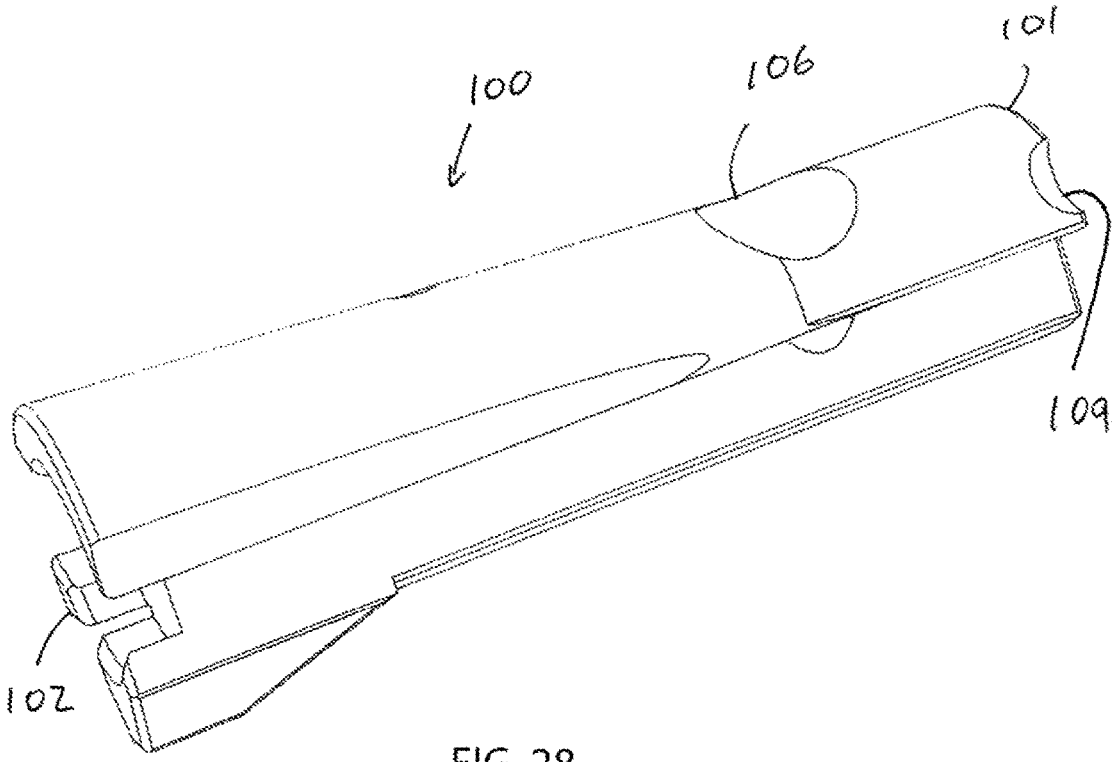
FIG. 28 is an alternative perspective view of the bolt.
Figure 29:
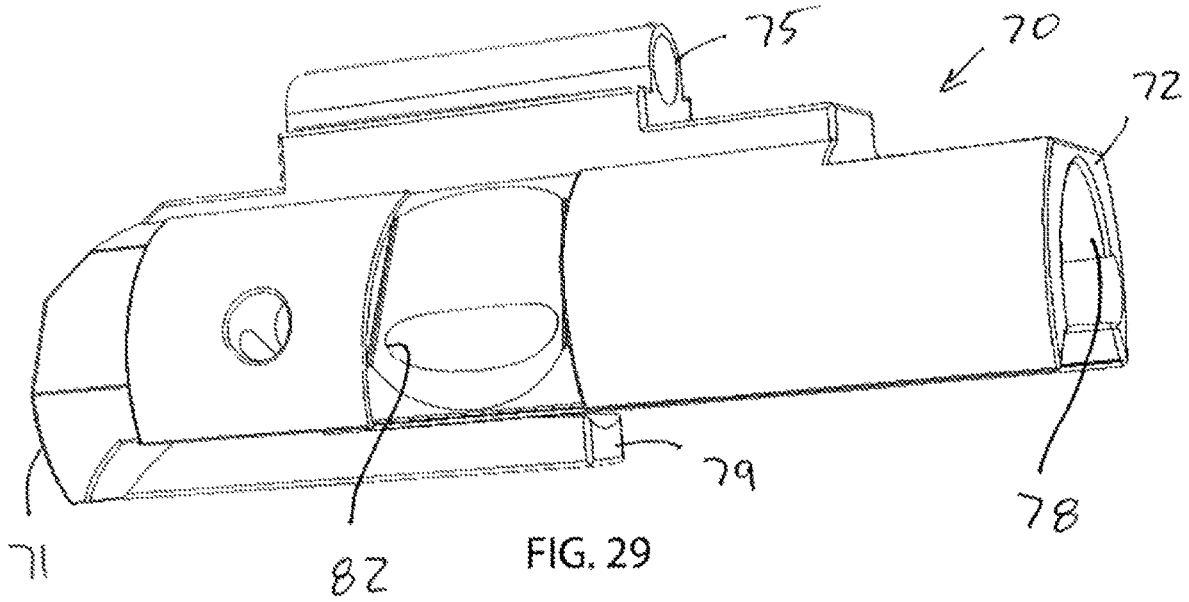
FIG. 29 is a perspective view of the bolt body.

The assembly of the present invention is illustrated in FIGS. 10-17. The bolt 100 is slid into hold hole 78 from end 72 of the bolt body 70. Cam pin 130 is inserted through cam pin hole 82 of the bolt body 70 and into cam pin pocket 106 of the bolt. The cam pin hole 82 is longer in the longitudinal direction that the width of the cam pin 130 as seen in FIG. 13. Then, the firing pin 140 is inserted through the firing pin hole 83 of the bolt body 70 in end 71 of the bolt body 70 and into the firing pin hole 107 of the bolt 100 in end 101. Lastly, the cotter pin 150 is inserted into the cotter pin hole 84 of the bolt body to lock the firing pin 140 in place. It is appreciated that a firing pin spring 141 is provided that is under compression and biases the firing pin towards its retracted position relative to the bolt 100. This spring force acts against the bolt 100 as well biasing it so that end 102 projects forward from end 72 of the bolt body prior to the firearm being in battery as seen in FIGS. 8, 19 and 24.

The bolt 100 is locked when in battery. This position is best illustrated in FIGS. 9, 20, 21 and 25. In the locked position, the bearing pocket 108 forces roller bearing 90 into relief 55. Bearing pocket 109 also forces roller bearing 95 into relief 65. The roller bearings 90 and 95 thus prevent rearward motion of the bolt 100 along the rods 40, 50 and 60 while locked. The initial high pressure of the explosion when firing a bullet also forces the bolt to maintain locking pressure keeping the roller bearings in the reliefs.

Figure 2:
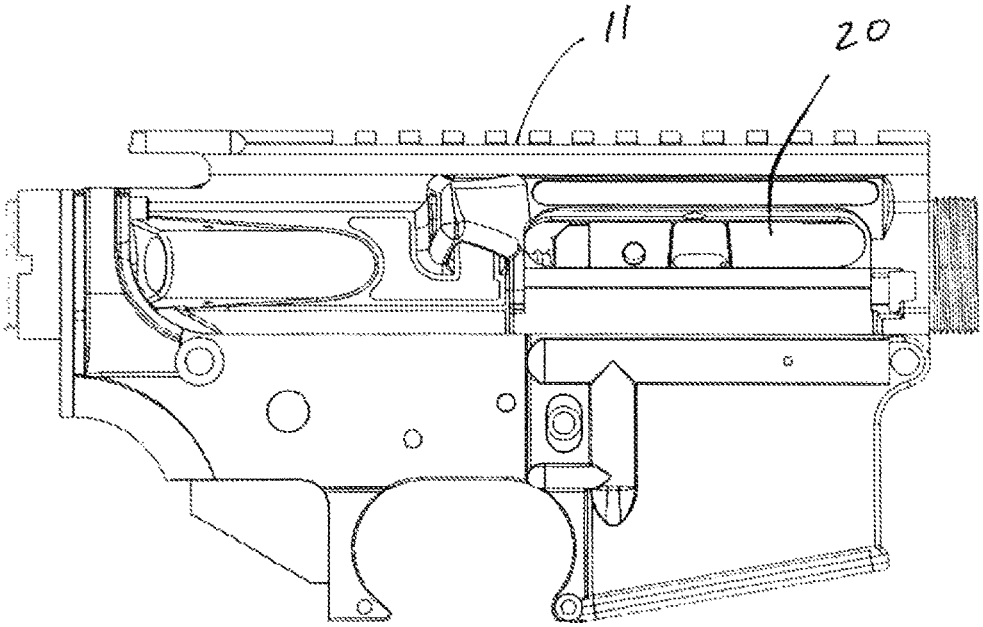
FIG. 2 is a side view of an upper and lower receiver containing the present invention.
Figure 3:
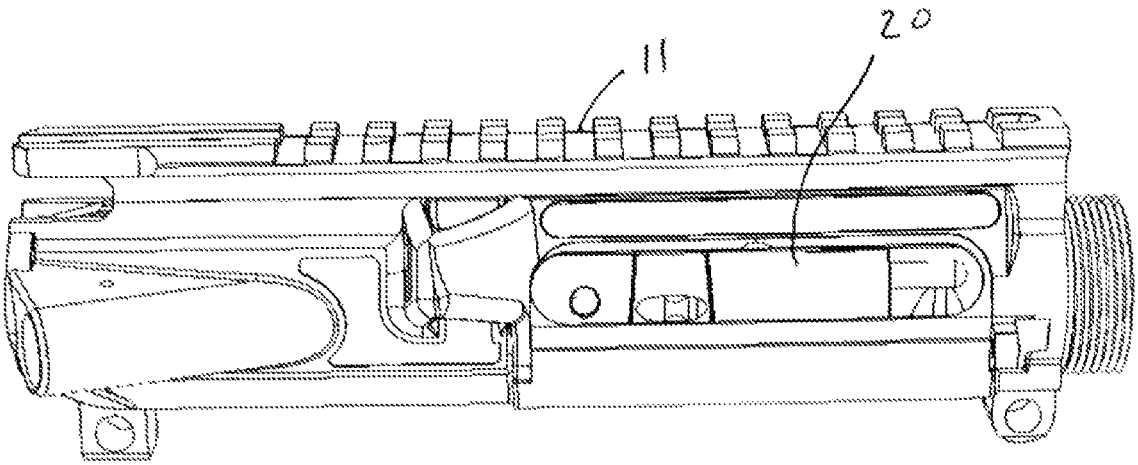
FIG. 3 is similar to FIG. 2 but shows the bolt body near the start of the reciprocation process.
Figure 4:
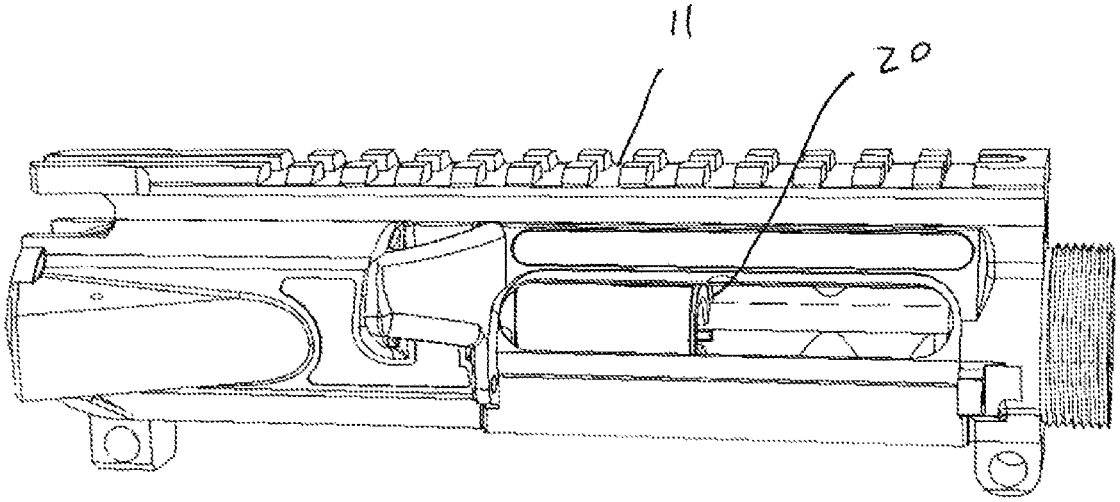
FIG. 4 is similar to FIG. 2 but shows the bolt body in the fully rearward position.
Figure 5:
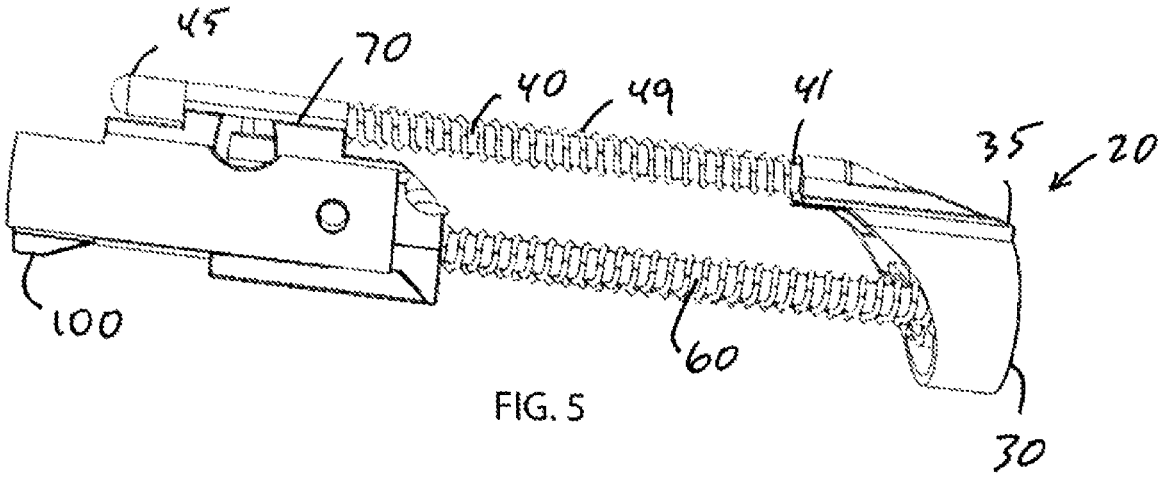
FIG. 5 is a side view of a preferred embodiment of an assembly that is self-locking.
Figure 6:
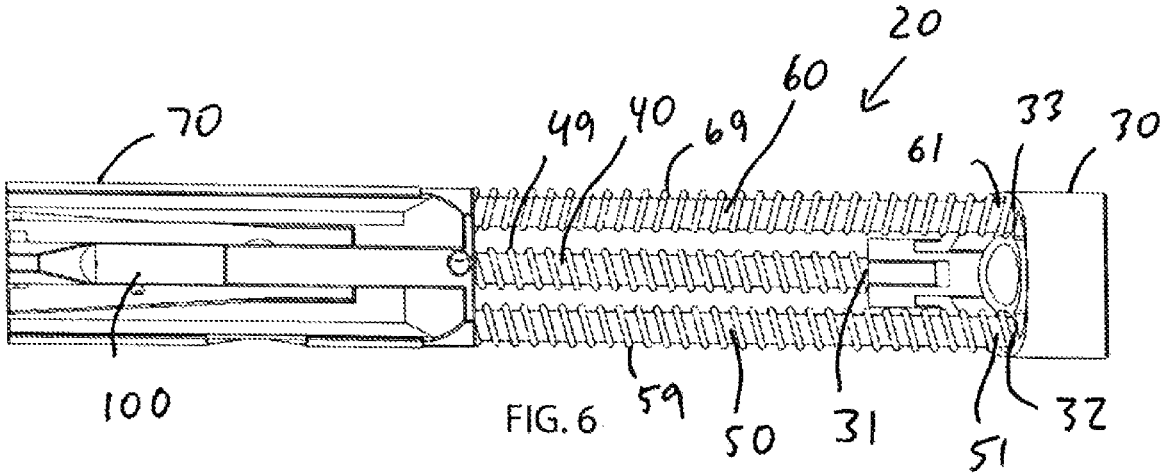
FIG. 6 is a bottom view of the assembly illustrated in FIG. 5
Figure 7:
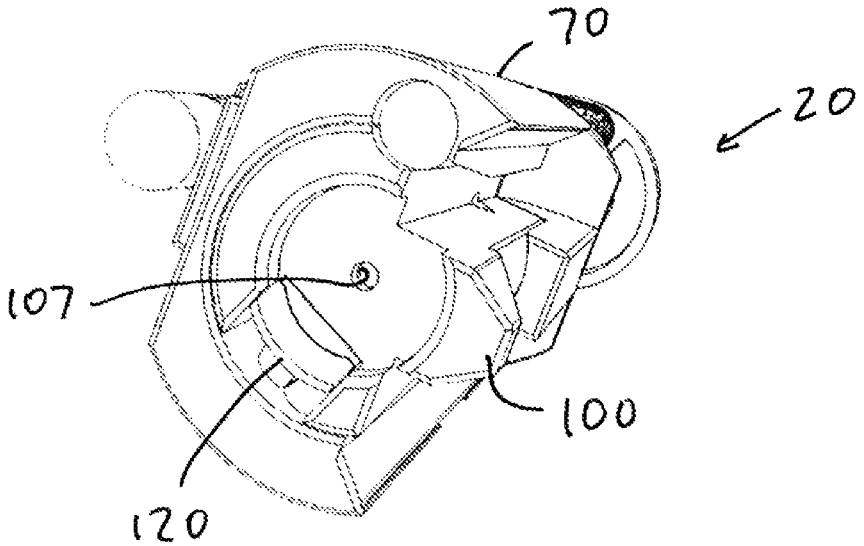
FIG. 7 is an end view of the assembly illustrated in FIG. 5.
Figure 30:
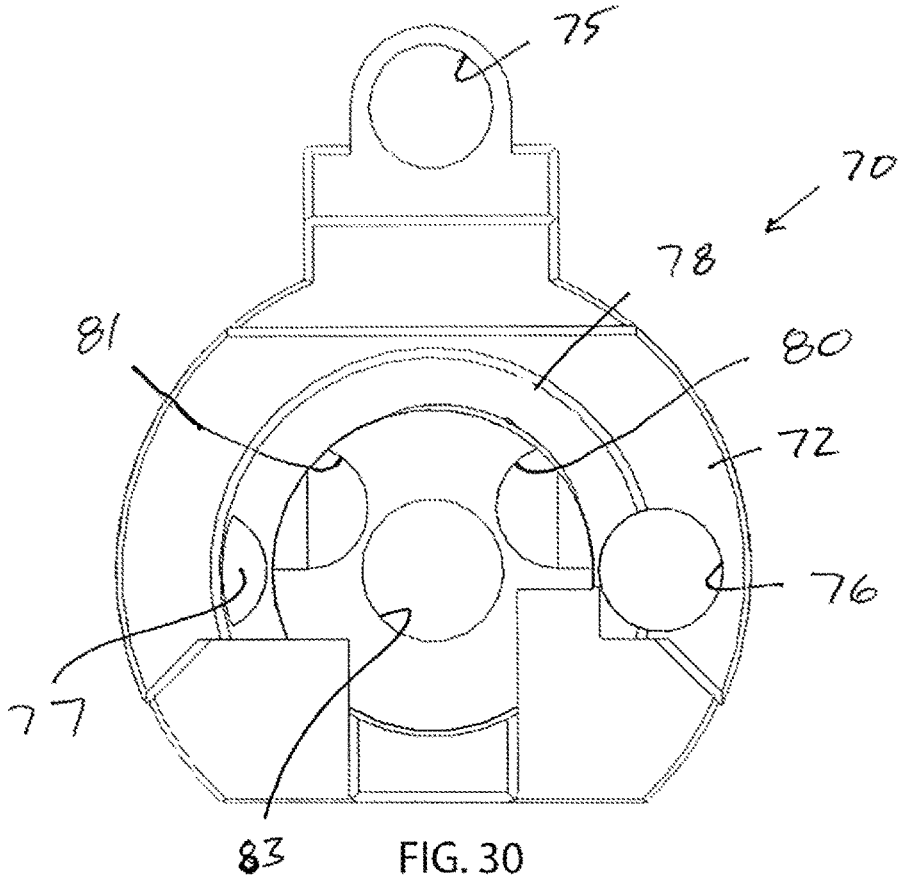
FIG. 30 is an end view of the bolt body.

As the bolt body 100 begins to travel rearward under the force of inertia, the roller bearings 90 fall out of reliefs 55 and 65, respectively, and move within pockets 80 and 81 so that the bolt 100 is no longer locked. Pockets 80 and 81 are best seen in FIG. 30. The bolt can then complete the reciprocation (while ejecting a casing and moving another bullet into a firing position) as the firearm returns to battery. FIG. 2 illustrates the firearm in battery. FIG. 3 illustrates the bolt body position at the start of reciprocation. FIG. 4 illustrates the bolt body position when the bolt body is in a rearward position during reciprocation.

A second embodiment of an assembly 220 the present invention is illustrated in FIGS. 31-46. The assembly 220 also replaces a bolt and recoil spring of traditional firearms. The assembly 220 has a base plate 230, an upper recoil rod 240, two lower recoil rods 250 and 260, respectively, a bolt body 270, a bolt 290, a lock lever 300, a cross pin 320 and a cam pin 330. Each of these components is described below.

Figure 31:
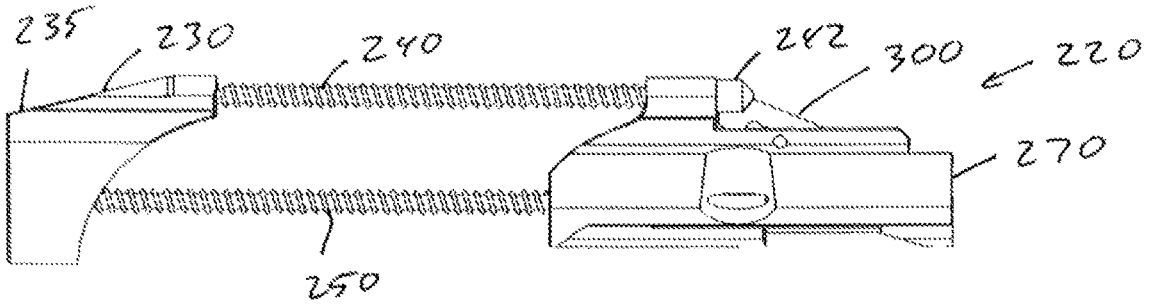
FIG. 31 is a side view of an alternative embodiment of the present invention.
Figure 32:
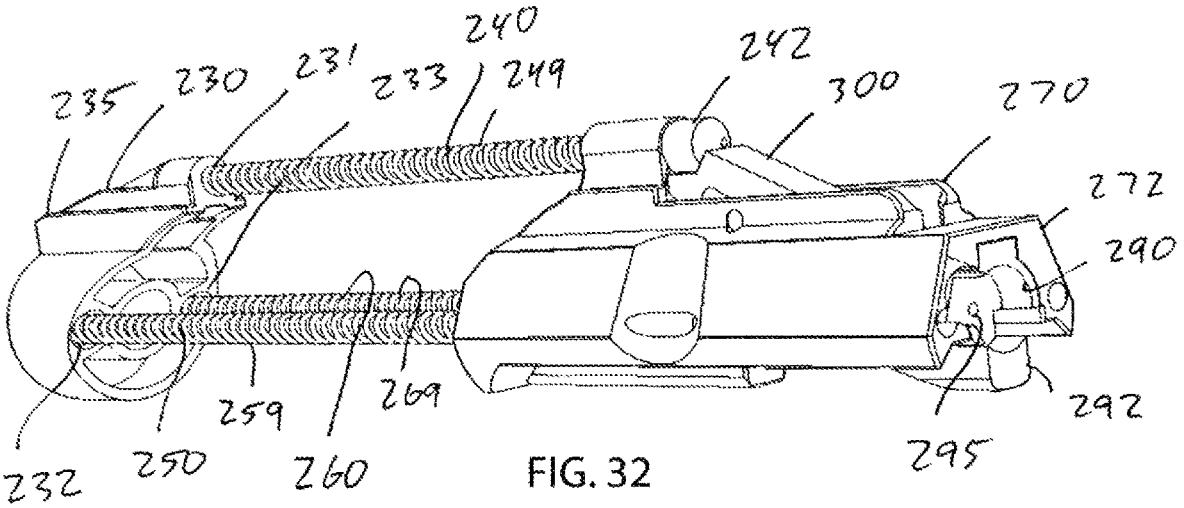
FIG. 32 is a perspective view of the embodiment illustrated in FIG. 31.
Figure 33:
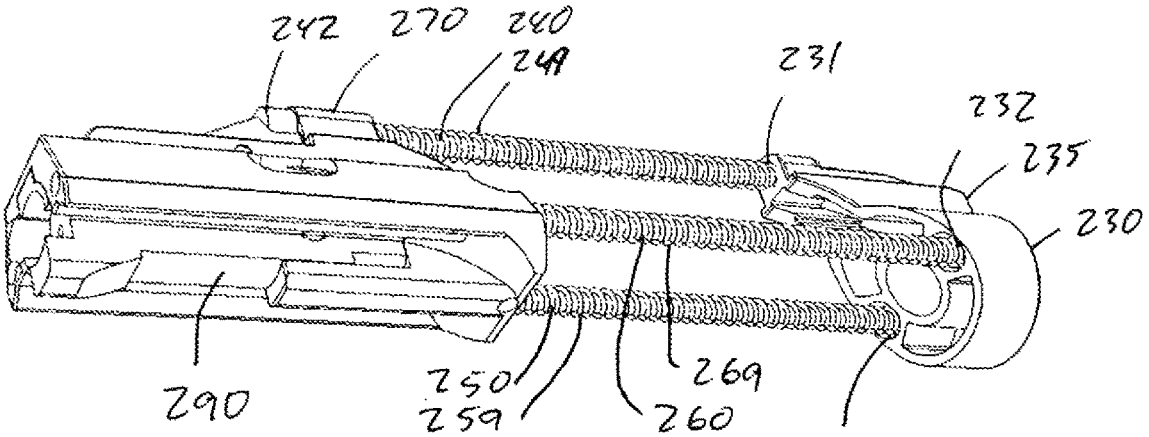
FIG. 33 is an alternative perspective view of the embodiment illustrated in FIG. 31.
Figure 34:
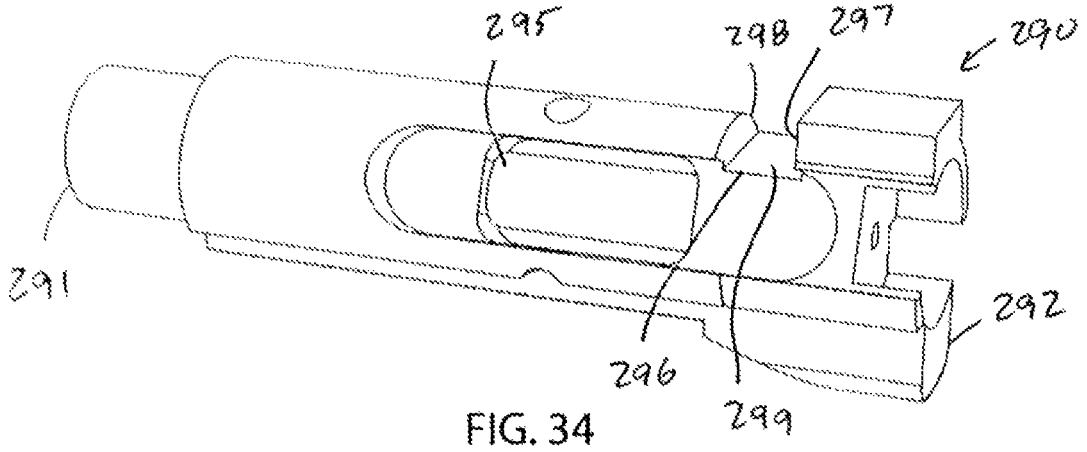
FIG. 34 is a perspective view of the bolt.
Figure 35:
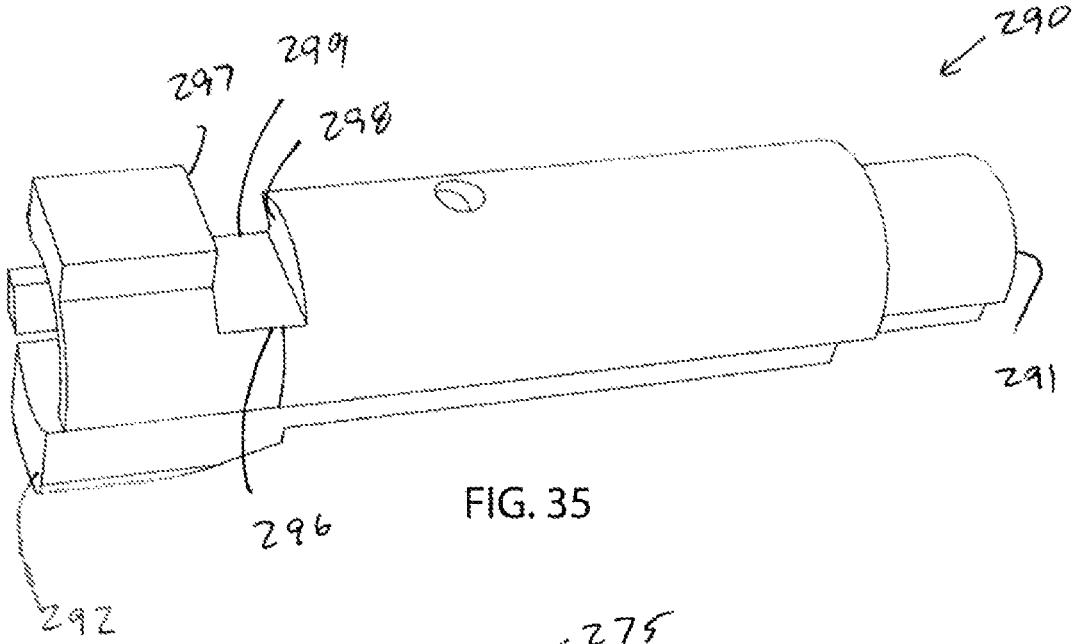
FIG. 35 is an alternative perspective view of the bolt.
Figure 36:
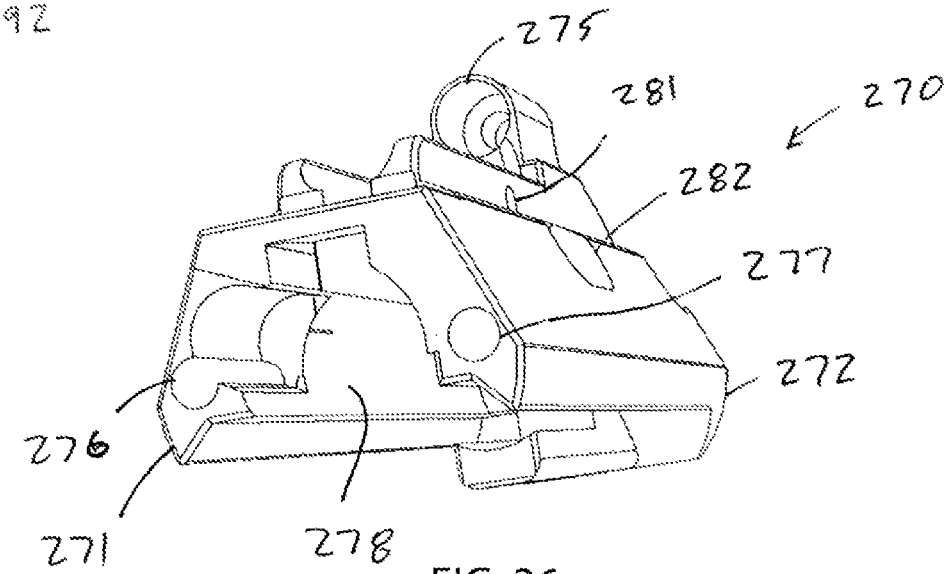
FIG. 36 is a perspective view of the bolt body.
Figure 37:
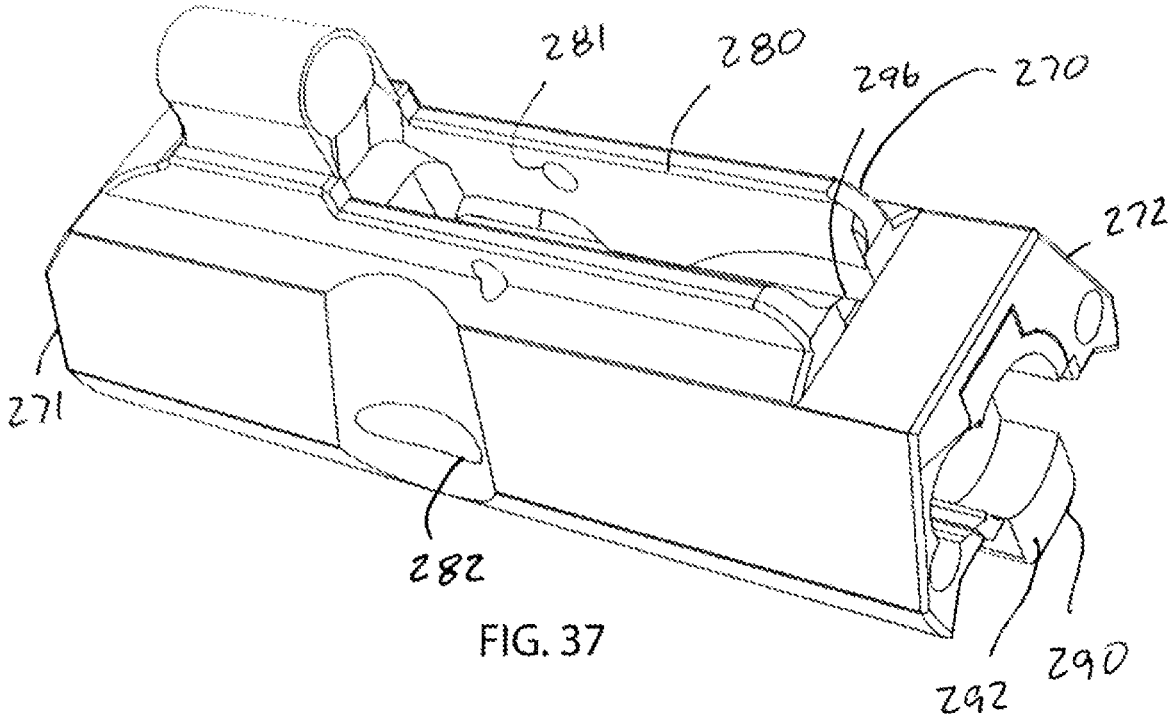
FIG. 37 is a perspective view showing the bolt within the bolt body.

The base plate 230 can be best seen in FIGS. 31-33. Base plate 230 has a hole 231 for receiving the main recoil rod 240. Base plate 230 further has a hole 232 for receiving a lower recoil rod 250 and a hole 233 for receiving a second lower recoil rod 260. Holes 231, 232 and 233 do not pass entirely through the base plate 230. In this regard, the rods 240, 250 and 260 are stationarily held within the base plate 230. The base plate preferably has a round outer diameter and a key tab 235 that allows it to fit into the upper receiver, but not allowed to travel into the lower receiver buffer tube as it is a round shape only.

The top recoil rod 240 can be best seen in FIGS. 31-33. Recoil rod 240 has two opposed ends. A head 242 is at the forward end and has a larger diameter than the body of the rod. The rearward end is received within hole 231 of the base plate 230. A spring 249 is around the perimeter of the rod 240.

Lower recoil rod 250 can be best seen in FIGS. 31-33. Recoil rod 250 has two opposed ends. The rearward end is received within hole 232 of the base plate 230. A spring 259 is around the perimeter of the rod 250.

A second lower recoil rod 260 can be best seen in FIGS. 31-33. Recoil rod 260 has two opposed ends. The rearward end is received within hole 233 of the base plate 230. A spring 269 is around the perimeter of the rod 260.

The top recoil rod 240 has a top rod axis. The first lower recoil rod 250 has a first recoil rod axis and the second lower recoil rod 260 has a second lower recoil rod axis. The top recoil rod axis is parallel to each lower recoil rod axis.

It is appreciated that while three recoil rods are illustrated, that there could be more or fewer recoil rods without departing from the broad aspects of the present invention. It is also appreciated that each rod does not need to have a spring around it. It is further appreciated that a recoil spring does not need to surround a rod.

The bolt body 270 is best seen in FIGS. 31-33, 36, 37, 39, 42 and 45. Bolt body 270 has an end 271 and an end 272. The bolt body 270 has several holes for receiving other components, including three recoil rod holes 275, 276 and 277, respectively, bolt hole 278, lock lever hole 280, cross pin hole 281 and cam pin hole 282 (for receiving a cam pin 330).

The recoil hole 275 movably receives the forward end of the upper recoil rod 240. The head of the recoil rod prevents the bolt body 270 from forwardly escaping the recoil rod 240. The spring 249 is between the base plate 230 and the bolt body 270. The spring 249 biases the bolt body 270 away from the base plate 230 and compresses when the bolt body 270 moves towards the base plate 230.

The recoil hole 276 movably receives the forward end of lower recoil rod 250. Spring 259 is between the base plate 230 and the bolt body 270. The spring 259 biases the bolt body 270 away from the base plate 230 and compresses when the bolt body 270 moves towards the base plate 230.

The recoil hole 277 movably receives the forward end of lower recoil rod 260. Spring 269 is between the base plate 230 and the bolt body 270. The spring 269 biases the bolt body 270 away from the base plate 230 and compresses when the bolt body 270 moves towards the base plate 30.

The bolt 290 is best seen in FIGS. 32-35, 37, 38, 41 and 44. The bolt 290 has a first end 291 and a second end 292. The bolt 290 has a firing pin hole 295 through which a firing pin is operable. The bolt 290 further has a pocket 296 formed into the upper surface. The pocket 296 has a front wall 297, a rear wall 298 and a bottom 299.

Lock lever 300 is illustrated in FIGS. 38-46. The lock lever 300 has a first end 301 and a second end 302. A notch 305 is formed in the sidewall near end 302 creating a return face 306. The notch 305 allows the second end to rotate within the pocket 296 of the bolt. The second end 302 also has a stop face 307. The stop face 307 abuts the front wall 297 and the bottom 299 of the pocket 296 when the firearm is in battery. The return face 306 abuts the rear wall 298 of the pocket 296 when the firearm is out of battery. The lock lever 300 further has a seat 210 at the first end 301 that mates with the head 242 at the first end of the main recoil rod 240 when the firearm is in battery.

Cross pin 320 is movably received within slot 315 of the lock lever 300. The slot 315 has a first end 316 and a second end 317. Cross pin 320 is stationarily received within cross pin holes 281 of the bolt body. End 302 of lock lever 300 is rotatably received within the pocket 296 of the bolt. The location of the cross pin 320 within the slot 315 determines the angular orientation of the lock lever 300, and thus whether the lock lever locks the bolt 290 relative to the upper recoil rod 240.

Figure 38:
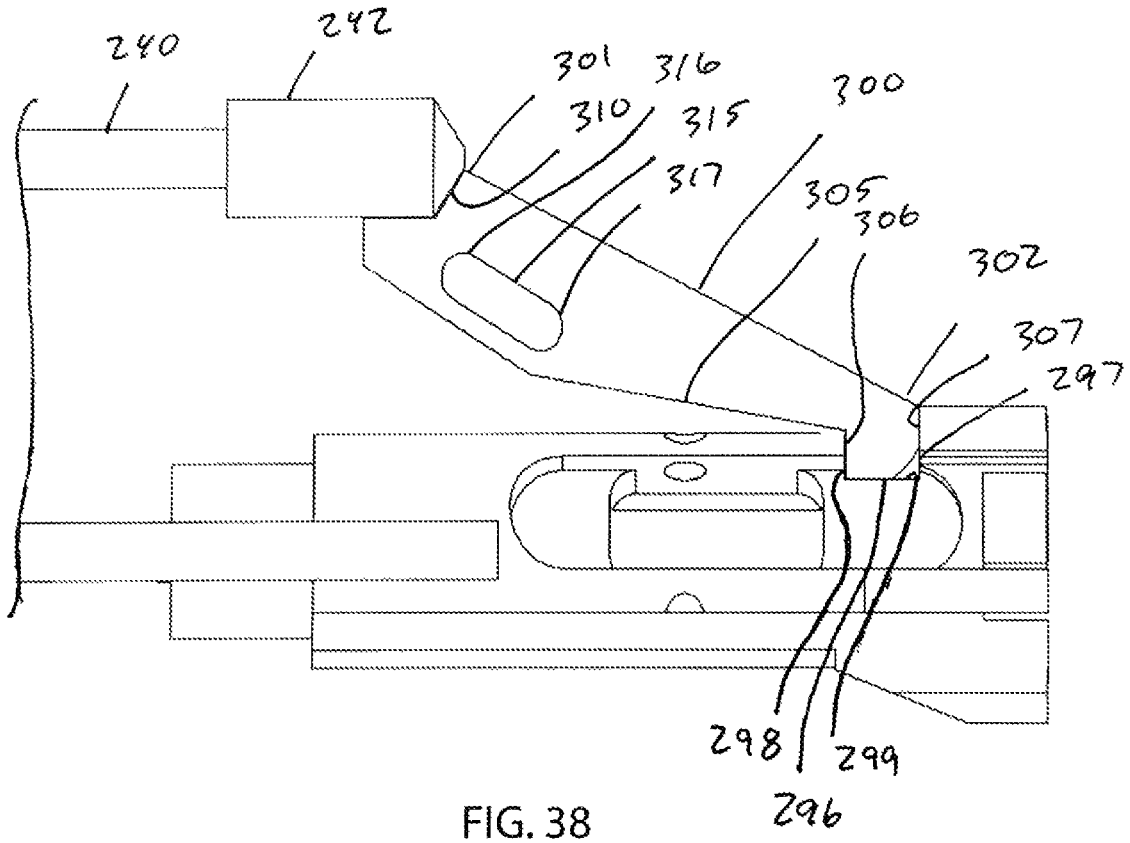
FIG. 38 is a side view showing the bolt in the locked position.
Figure 39:
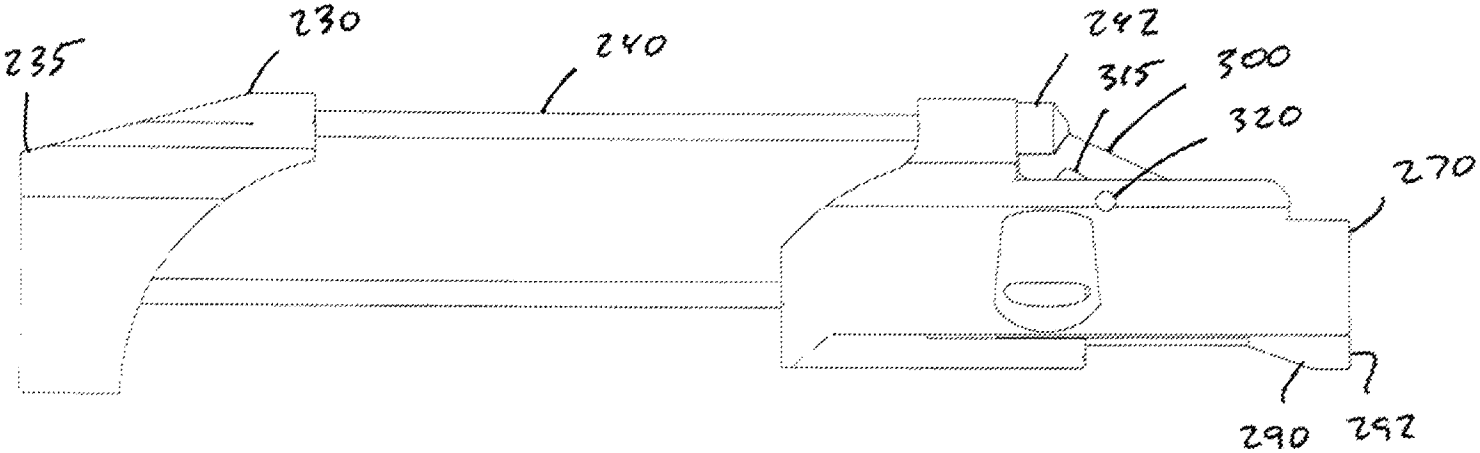
FIG. 39 is similar to FIG. 38 but additionally shows the bolt body.
Figure 40:
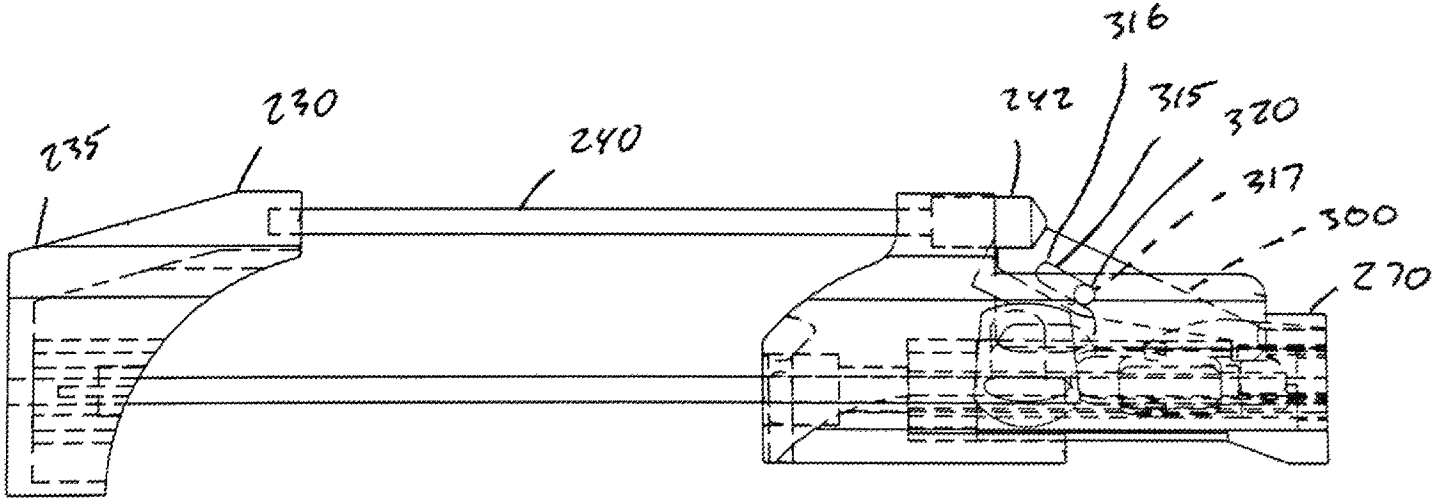
FIG. 40 is a wireframe view of FIG. 39.

The bolt 290 is locked when in battery. This position is best illustrated in FIGS. 38-40. In the locked position, the stop face 306 abuts the front wall 297 of the pocket, the cross pin 320 is at end 317 of the slot 315, and the seat 310 engages the head 242 of the main recoil rod 240. The initial high pressure of the explosion when firing a bullet also forces the bolt to maintain locking pressure keeping the roller bearings in the reliefs.

Figure 41:
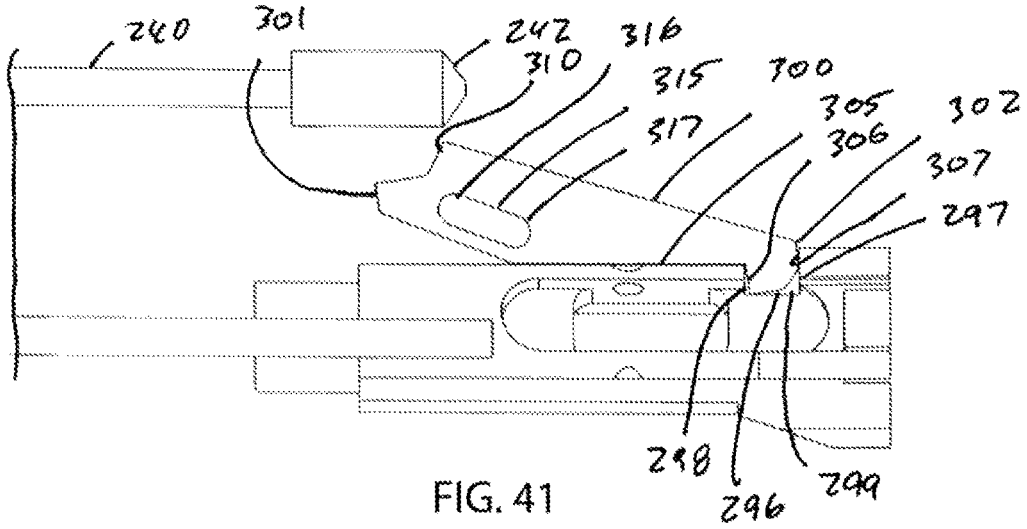
FIG. 41 is a side view showing the bolt in the unlocked position before reciprocation.
Figure 42:
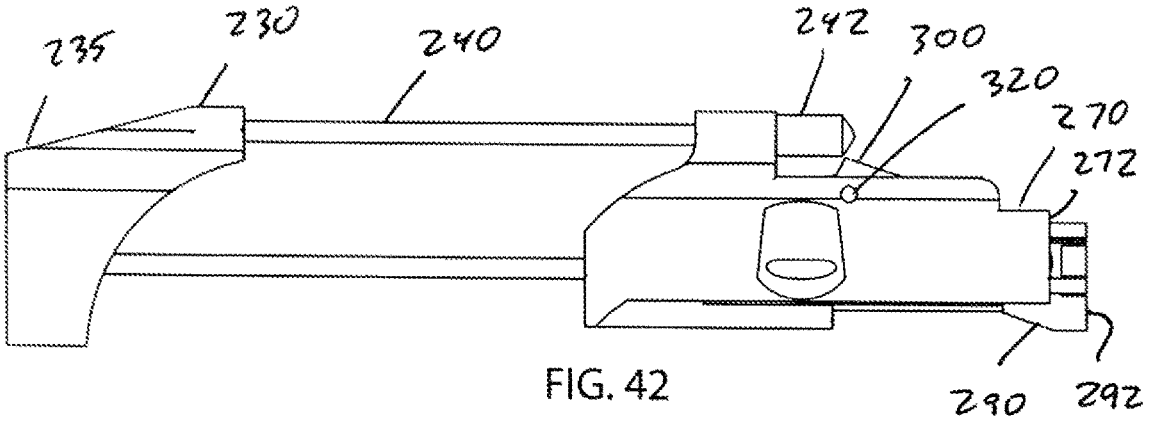
FIG. 42 is similar to FIG. 41 but additionally shows the bolt body.
Figure 43:
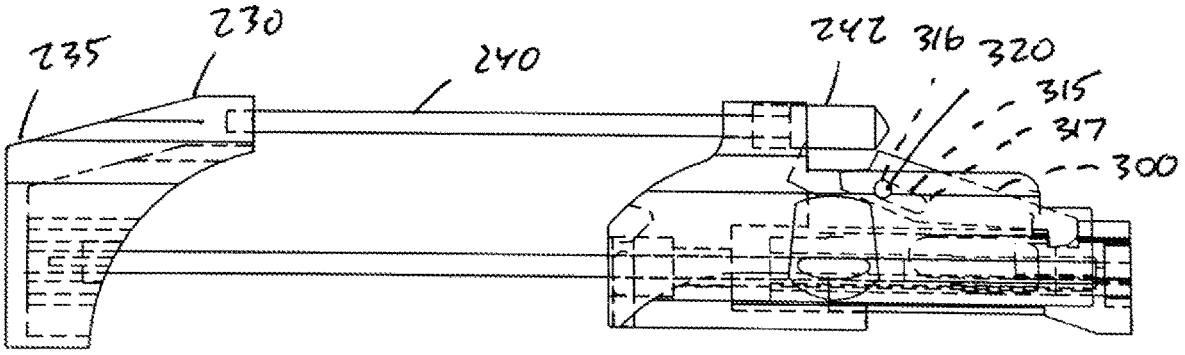
FIG. 43 is a wireframe view of FIG. 42.
Figure 44:
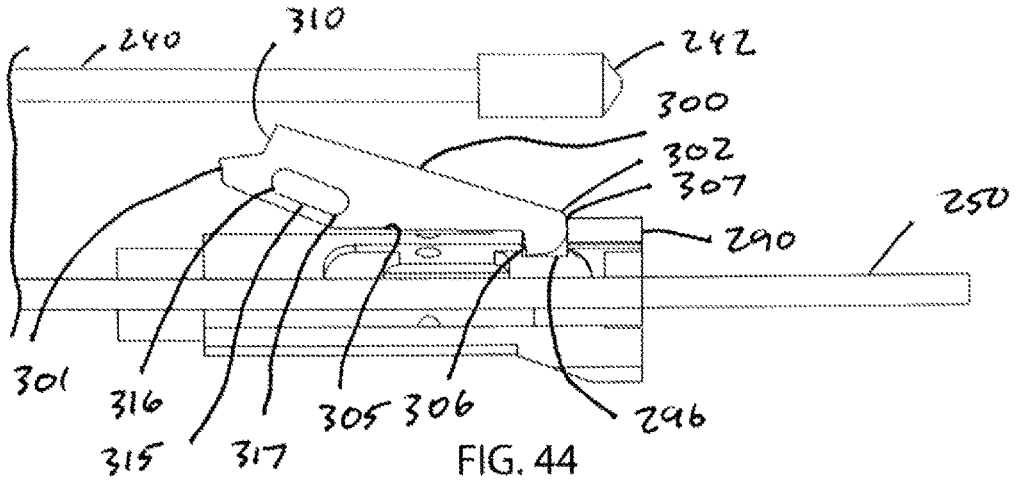
FIG. 44 is a side view showing the bolt in the fully reciprocated position.
Figure 45:
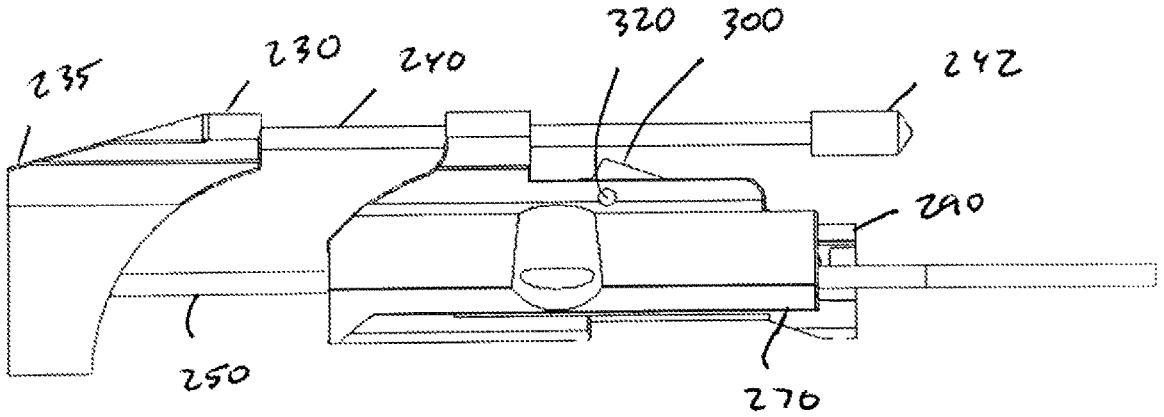
FIG. 45 is similar to FIG. 44 but additionally shows the bolt body.
Figure 46:
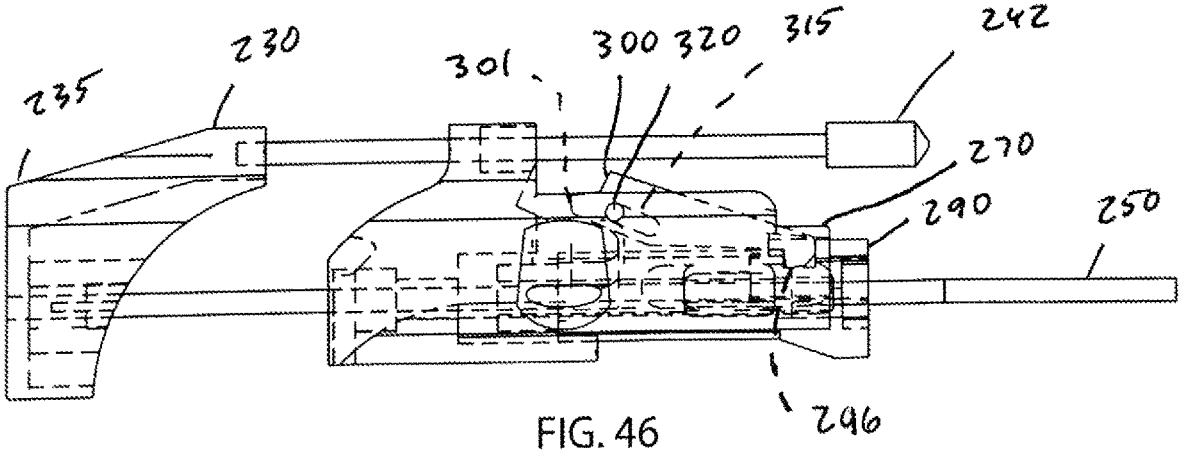
FIG. 46 is a wireframe view of FIG. 45.
Figure 47:
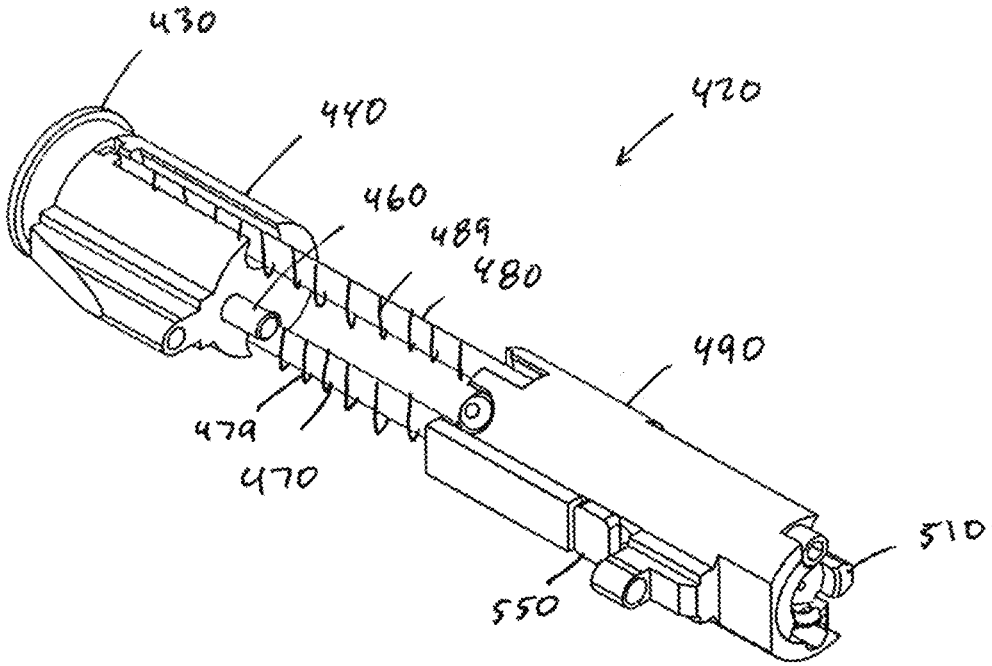
FIG. 47 is a perspective view of an alternative preferred embodiment of the present invention.
Figure 48:
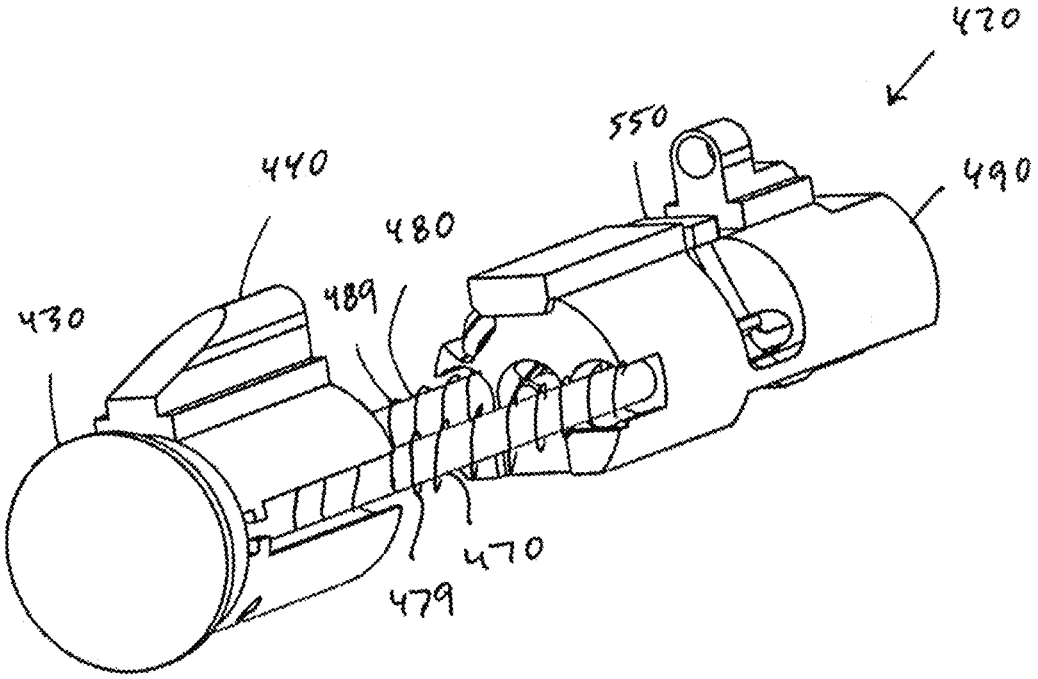
FIG. 48 is an alternative perspective view of the embodiment shown in FIG. 47.
Figure 49:
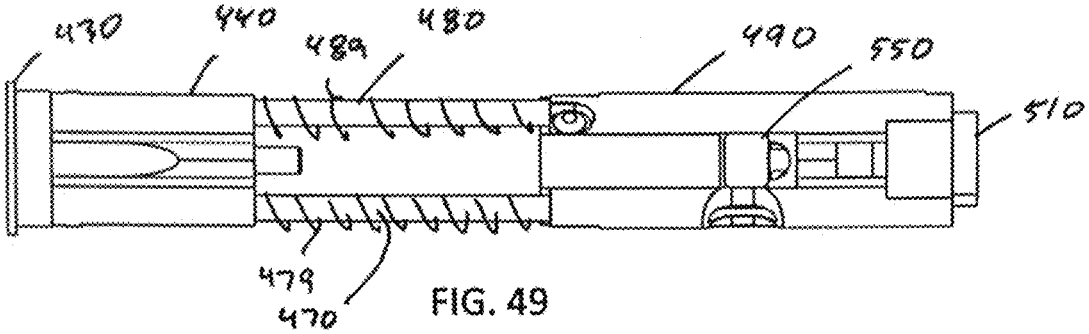
FIG. 49 is a top view of the embodiment illustrated in FIG. 47.
Figure 50:
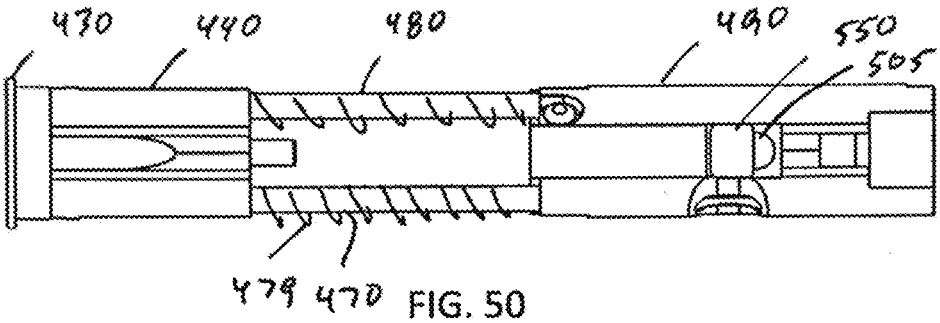
FIG. 50 is similar to FIG. 49 but shows the bolt positioned in battery.
Figure 51:
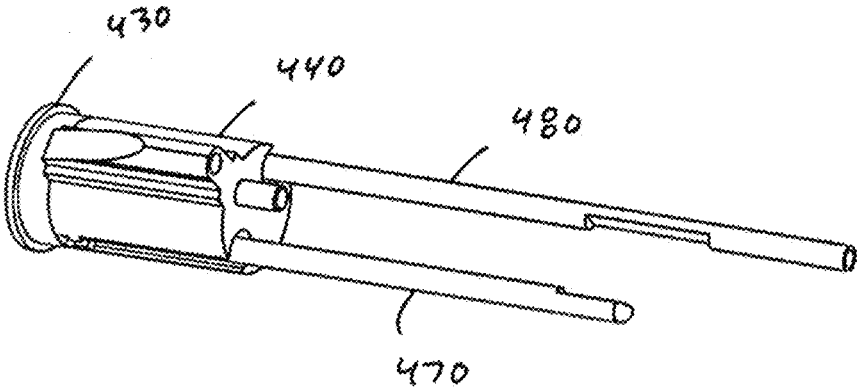
FIG. 51 is a perspective view showing a base plate, a stroke limiter, and two rods.
Figure 52:
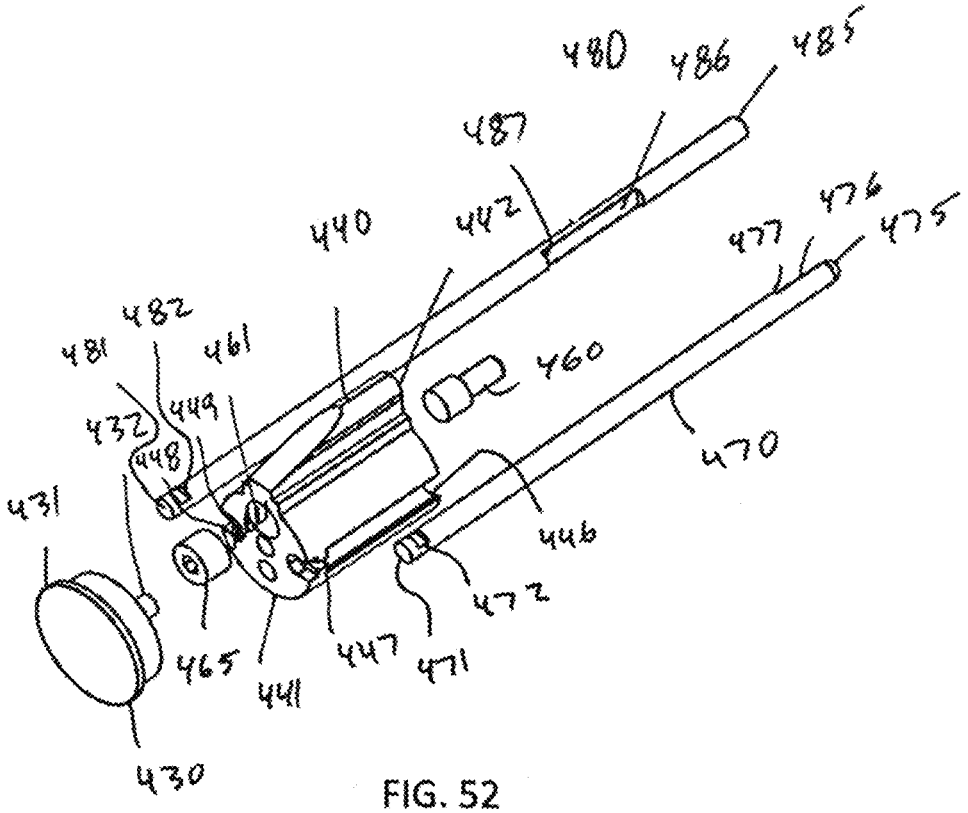
FIG. 52 is an exploded view of the components illustrated in FIG. 51.
Figure 53:
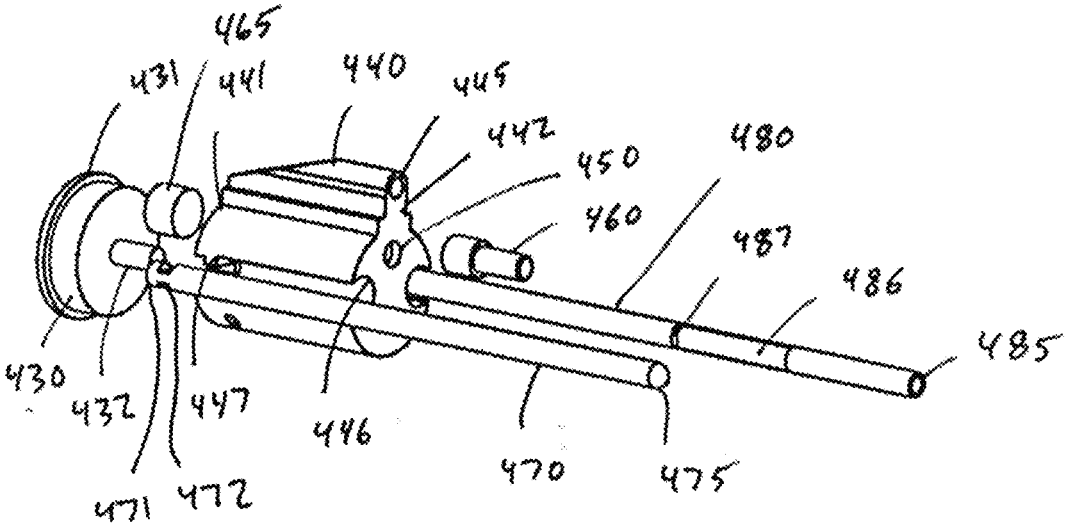
FIG. 53 is an alternative exploded perspective view of the components illustrated in FIG. 51.
Figure 54:
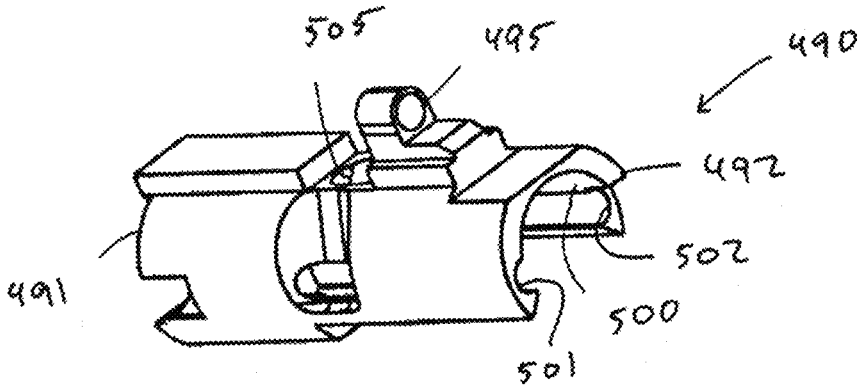
FIG. 54 is a perspective view of a bolt body.
Figure 55:
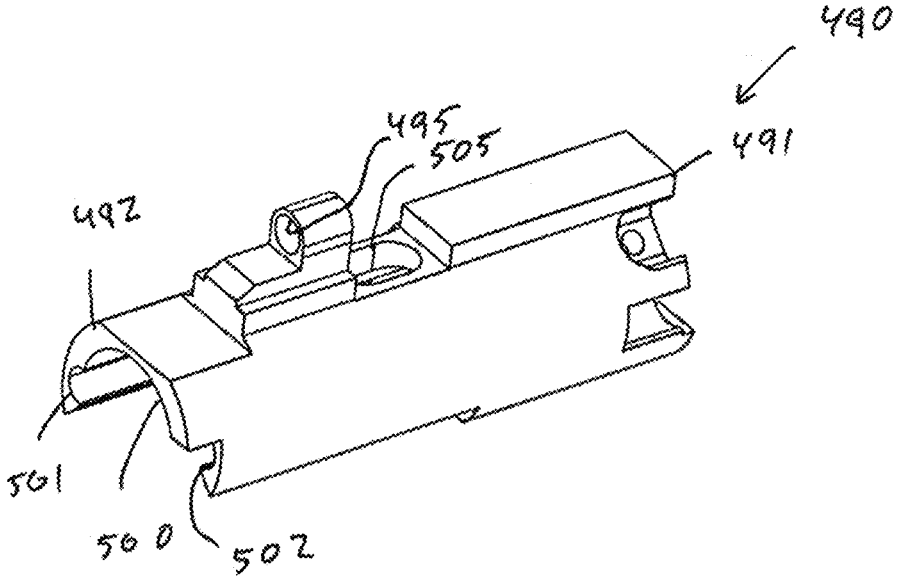
FIG. 55 is in reverse perspective view of the bolt body.
Figure 56:
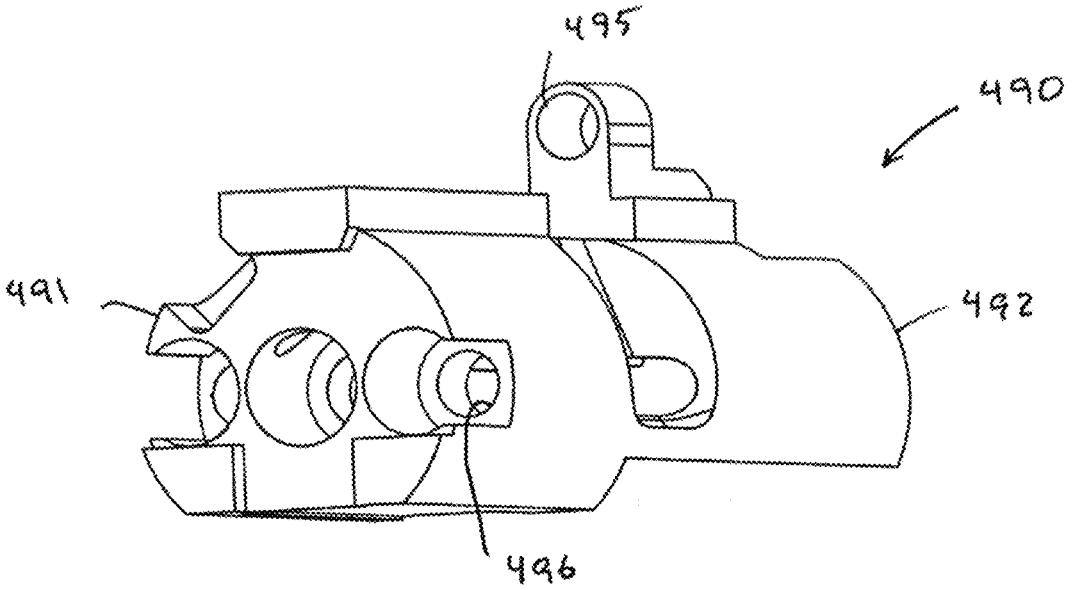
FIG. 56 is a further perspective you of the bolt body.
Figure 57:
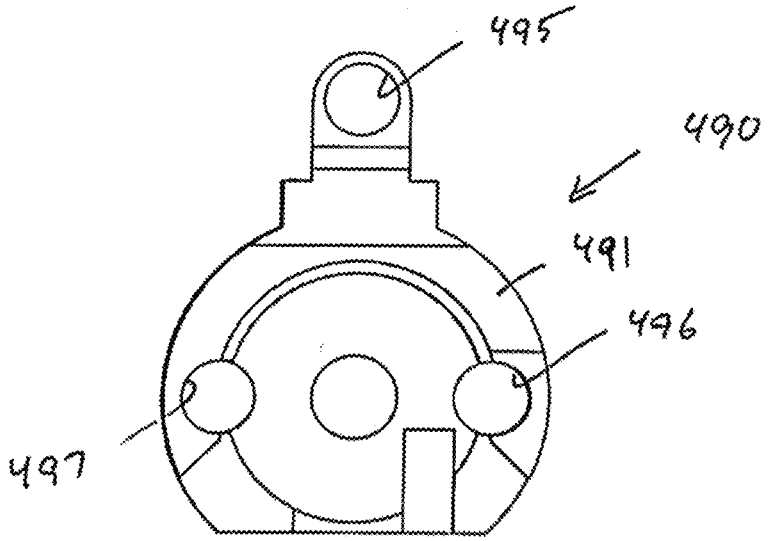
FIG. 57 is an end view of the bolt body.

As the bolt body 270 begins to travel rearward under force of inertia, as seen in FIGS. 41-43, the cross pin 320 moves to the first end 316 of the slot causing the first end 301 of the lock lever to move down vertically a sufficient amount to unlock the bolt 290. The bolt can then complete the reciprocation (while ejecting a casing and moving another bullet into a firing position) as the firearm returns to battery. The fully reciprocated position of the bolt 290 and bolt body 270 are illustrated in FIGS. 44-46.

Turning now to FIGS. 47-71, it is seen that an additional embodiment of the present invention is illustrated. The assembly 420 has a base plate 430, a stroke limiter 440, recoil rods 470 and 480, a bolt body 490, a bolt 510, a cam rotary lock 530 and a cam pin 550. Each of these components is described below.

The base plate 430 is best seen in FIGS. 47-48 and 54-53. The base plate 430 has a flange 431 at a first end and a post 432 projecting from the second end. The post is centrally located upon the second end of the base plate. The base plate prevents the end of the assembly from exiting the receiver.

The stroke limiter 440 is illustrated in FIGS. 47-53. The stroke limiter 440 has opposed ends 441 and 442. Rod holes 445 and 446 are on opposed sides of the stroke limiter 440. A retainer 447 is within hole 445 near end 441 of the stroke limiter. Similarly, a retainer 449 is within hole 446 near end 441 of the stroke limiter. The retainers are formed of a constriction within the holes that otherwise preferably have a constant profile. The stroke limiter also has a plunger hole 450 centrally aligned on the front end 442 of the stroke limiter 440.

A recoil plunger 460 is illustrated in FIGS. 47 and 49-53. The recoil plunger 460 is pressed into plunger hole 450 during reciprocation. A spring 461 is held within a pocket, held by said plunger retainer 465, to bias to recoil plunger to extend from the plunger hole 450.

A top rod, not shown, can optionally be used with the present invention.

Keeping with FIGS. 47-53, it is seen that a recoil rod 470 is provided. The rod 470 has ends 471 and 475. Notches 472 are formed into two sides of the rod 470 near end 471. The notches 472 allow the rod 470 to be laterally received within rod hole 446. The retainer 447 prevents longitudinal movement of the rod 470 relative to the stroke limiter 470. A relief 476 is formed into one side of the rod 470 near end 475. The relief 476 has a rear face or wall 477. The wall 477 in this embodiment is perpendicular to a rod longitudinal axis (0 degree angle offset from perpendicular to the longitudinal axis). A spring 479 preferably surrounds the rod 470. In this regard, the spring is compressed during the blowback and the expands to move the bolt forward to complete the reciprocation.

A rod 480 is also provided. The rod 480 has ends 481 and 485. Notches 482 are formed into two sides of the rod 480 near end 481. The notches 482 allow the rod 480 to be laterally received within rod hole 486. The retainer 487 prevents longitudinal movement of the rod 480 relative to the stroke limiter 480. A relief 486 is formed into one side of the rod 4780 near end 485. The relief 486 has a rear face or wall 487. The wall 487 in this embodiment is perpendicular to a rod longitudinal axis (0 degree angle offset from perpendicular to the longitudinal axis). A spring 489 preferably surrounds the rod 480. In this regard, the spring is compressed during the blowback and the expands to move the bolt forward to complete the reciprocation.

It is appreciated that while two recoil rods are illustrated, that there could be more or fewer recoil rods without departing from the broad aspects of the present invention. It is also appreciated that each rod does not need to have a spring around it. It is further appreciated that a recoil spring does not need to surround a rod.

The bolt body 490 is shown in isolation in FIGS. 54-57. The bolt body 490 has opposed ends 491 and 492. A top rod hole 495 can be provided when a top rod is desired. The bolt body has a rod hole 496 and a rod hole 497. The holes are between end 491 and a main cavity 500. The main cavity has two rod passage sidewalls 501 and 502, which partially continue the round profiles of holes 496 and 497, respectively. A top slot 505 is provided. The top slot is preferably straight and has a slot axis that is parallel with the bolt body longitudinal axis.

Figure 58:
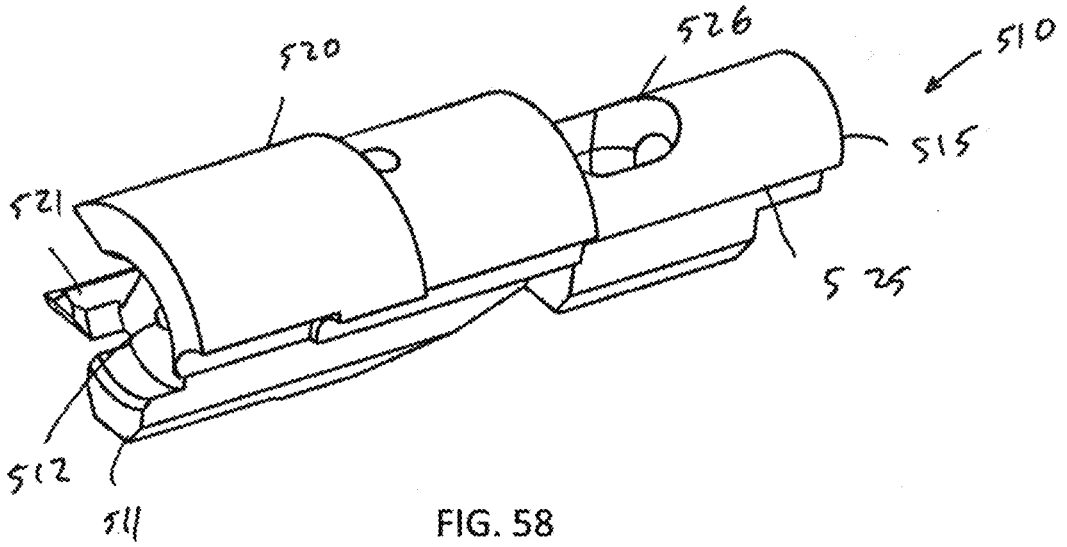
FIG. 58 is a perspective view of a bolt of the embodiment illustrated in FIG. 47.
Figure 59:
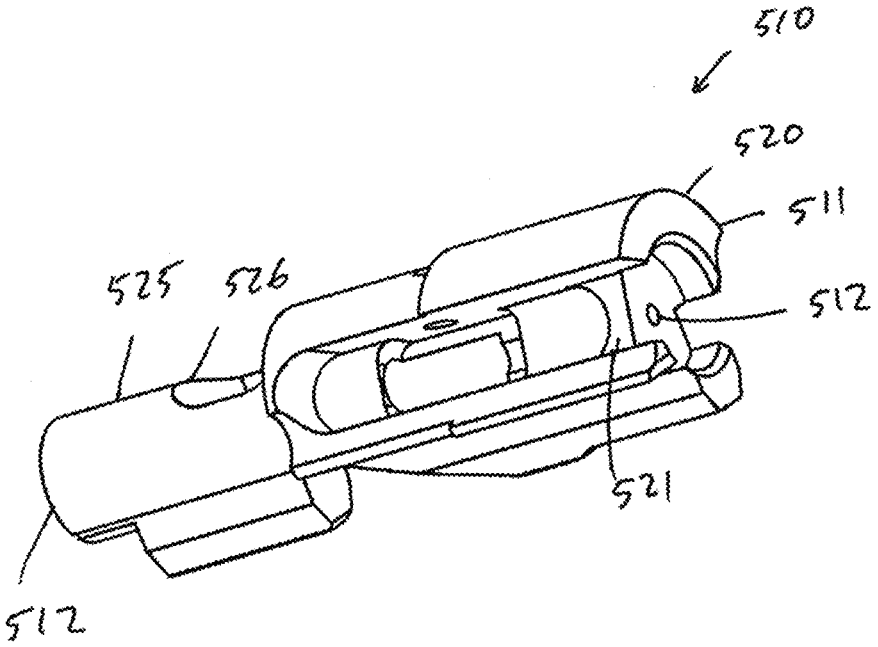
FIG. 59 is an alternative perspective view of the bolt.
Figure 60:
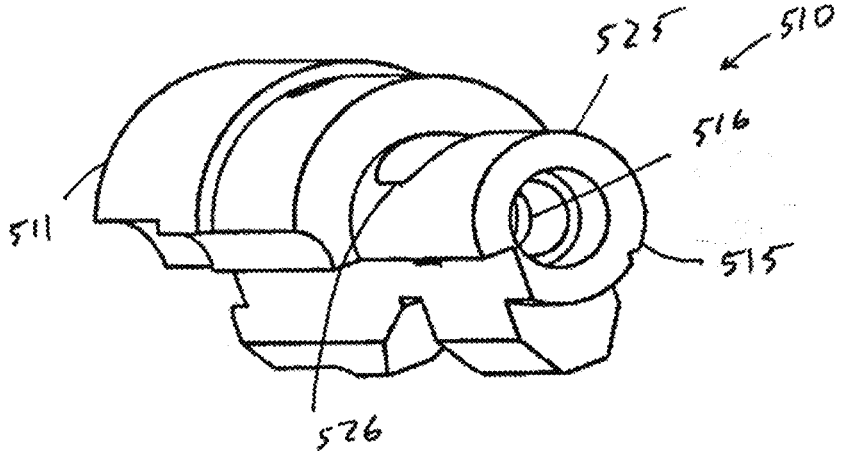
FIG. 60 is a further perspective view of the bolt.
Figure 61:
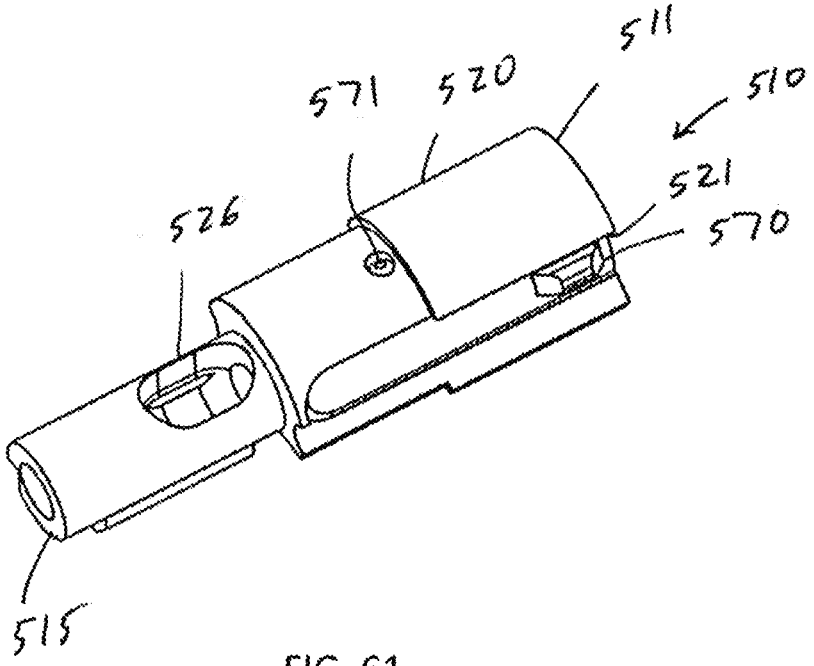
FIG. 61 is a perspective view of an extractor and the bolt.

The bolt 510 is shown in isolation in FIGS. 58-60 and is shown with extractor 570 and extractor retaining pin 571 in FIG. 61. The bolt 510 has an end 511 with a centrally located firing pin hole 512. The bolt has an opposed end 515 also with a centrally located firing pin hole 516. The bolt 510 has a first section 520 with a side located extractor pocket 521. The extractor 570 is pivotally held within the extractor pocket 521 with a pin 571 passing through first section of the bolt. The bolt 510 also has a second section. There is a slot 526 formed in the top of the bolt 510. The slot 526 is preferably a straight slot and has a slot axis that is parallel with the bolt longitudinal axis.

Figure 62:
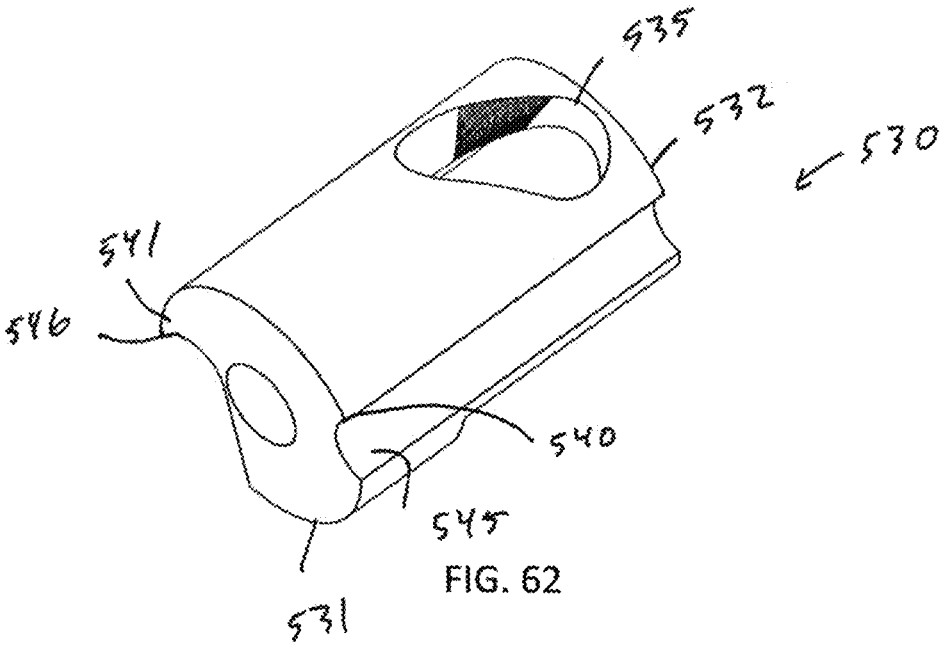
FIG. 62 is a perspective view of a cam rotary lock of the invention illustrated in FIG. 47.
Figure 63:
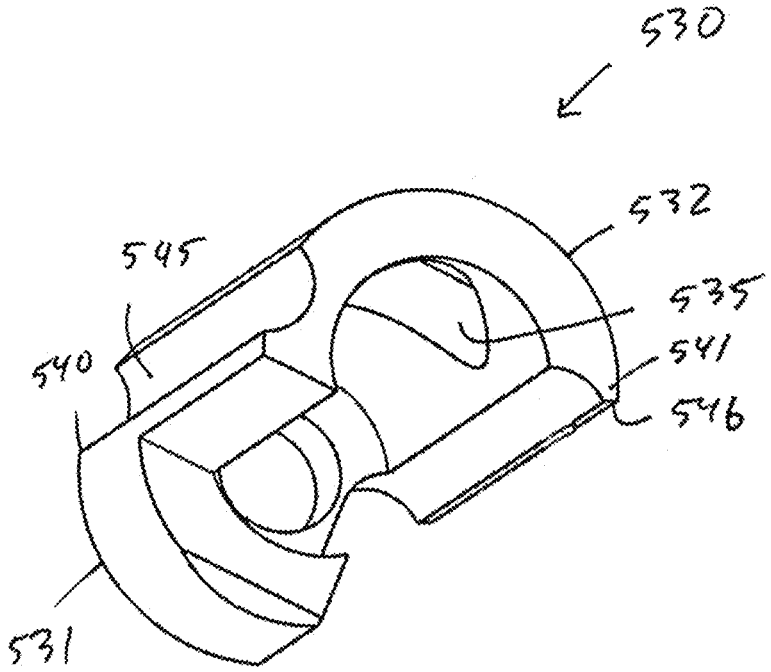
FIG. 63 is an alternative perspective view of the cam rotary lock.

A cam rotary lock 530 is illustrated in isolation in FIGS. 62 and 63. The cam rotary lock 530 has opposed ends 531 and 542. A slot 535 is formed through the top of the cam rotary lock 530. The slot 535 is preferably a straight slot and has a longitudinal axis that is not parallel with a cam rotary lock longitudinal axis. Two lock sections 540 and 541 are provided. The lock sections are part of the rear end face of the lock and are located adjacent to rod sidewalls 545 and 546, respectively, that pass along sides of the cam rotary lock.

Figure 64:
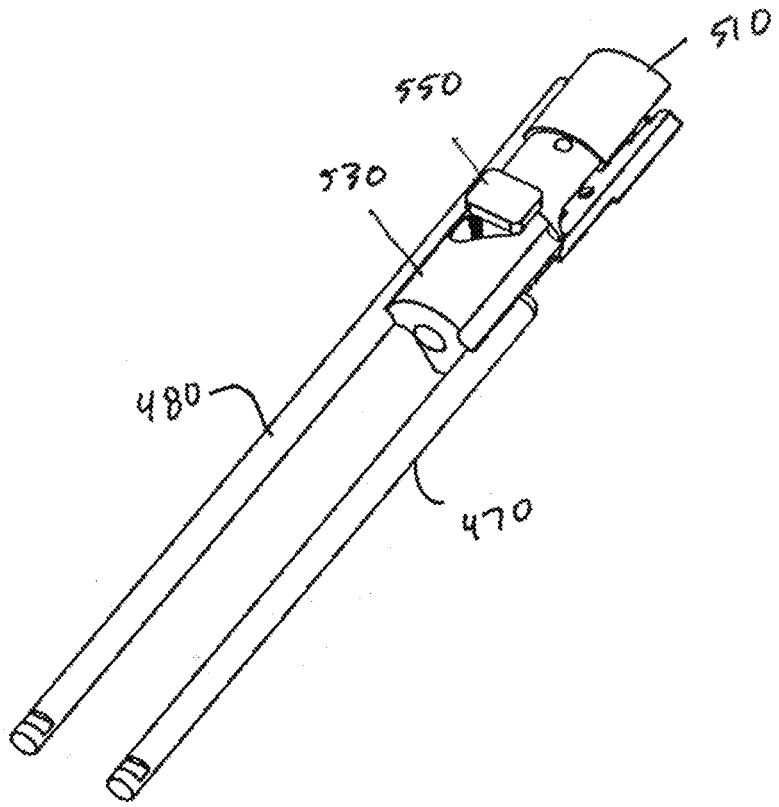
FIG. 64 is a perspective view of the rods, the cam rotary lock and a cam pin.
Figure 65:
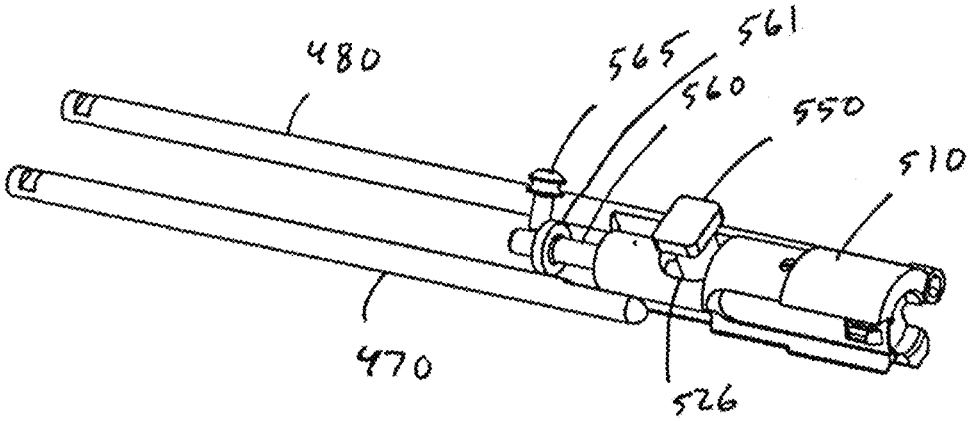
FIG. 65 is a perspective view showing the rods, the bolt, firing pin, and the cam pin.

End 471 of rod 470 and end 481 of rod 480 are received within rod holes 445 and 446, respectively, of the stroke limiter 440. The notch 472 of rod 470 allows the rod to clear the retainer 447, and the notch 482 of rod 480 allows the rod to clear the retainer 449. Springs 469 and 489 can then be inserted from the open ends of the rod holes. The springs preferably have a larger diameter than the side openings of rod holes of the stroke limiter 440. The rotary cam lock 530 fits over the top of the bolt 510 in the bolt second section 525, as seen in FIG. 64. Then, the bolt body 490 is fit over the bolt 510 and cam rotary lock 530 so that they are received within the main cavity 500.

Figure 66:
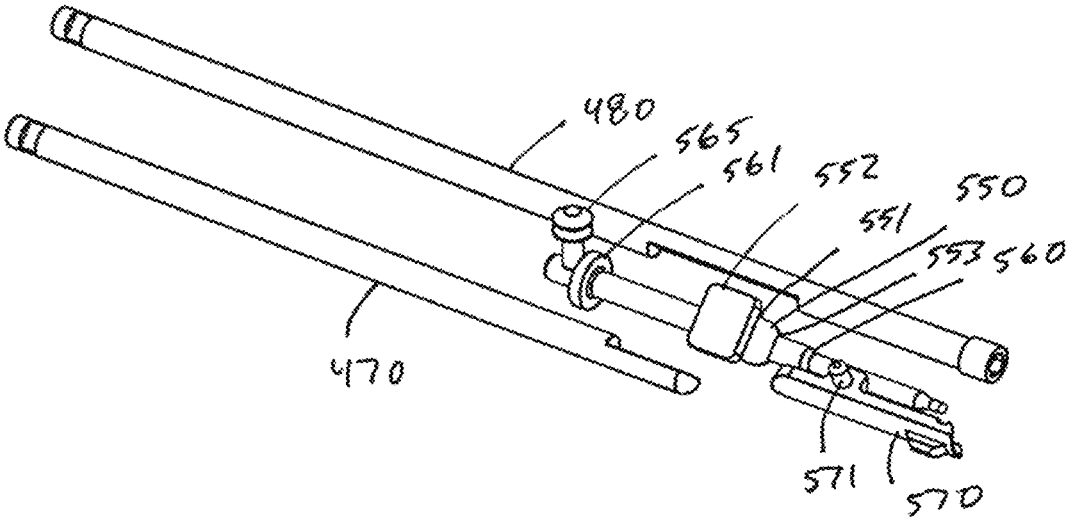
FIG. 66 is a perspective view showing two rods, the firing pin, and the extractor.
Figure 67:
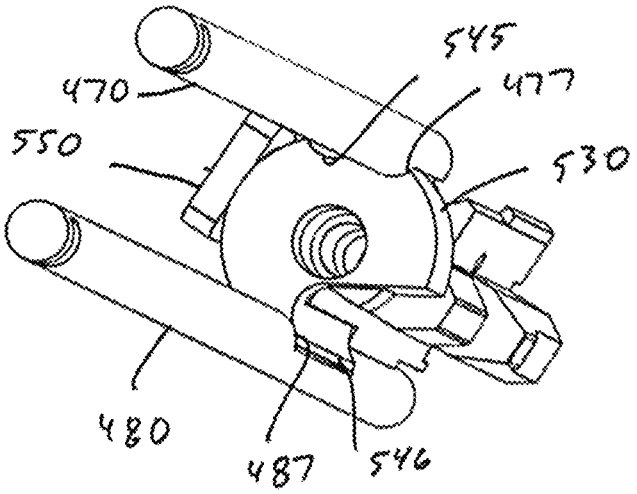
FIG. 67 is a perspective view of two rods in abutting engagement with the cam rotary lock.
Figure 68:
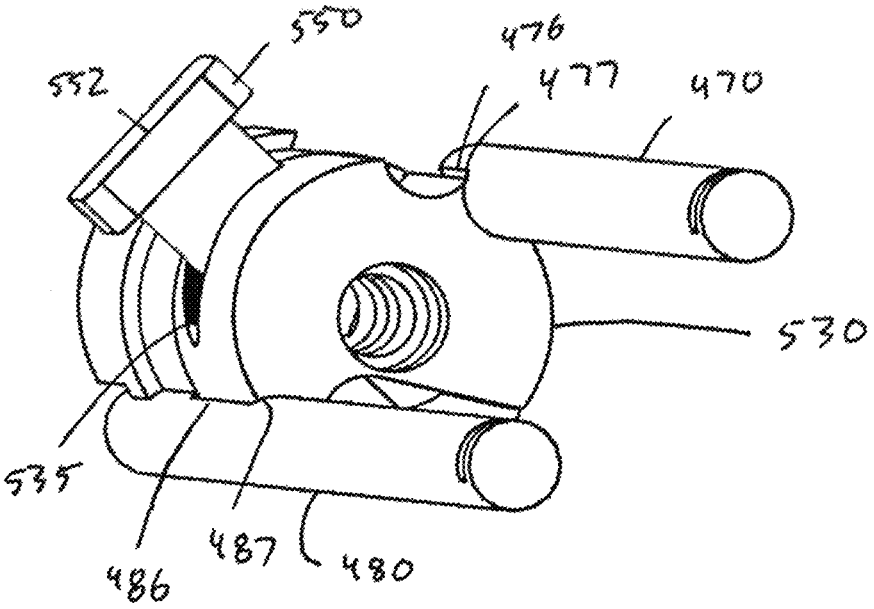
FIG. 68 is an alternative perspective view of the components illustrated in FIG. 67.
Figure 69:
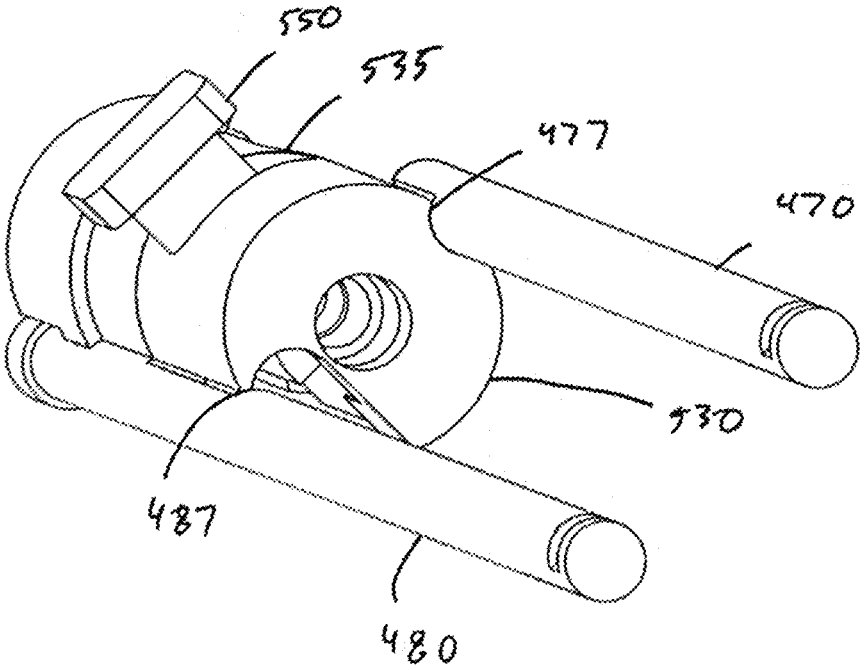
FIG. 69 is similar to FIG. 68 but shows the cam rotary lock rotated relative to the rods.
Figure 70:
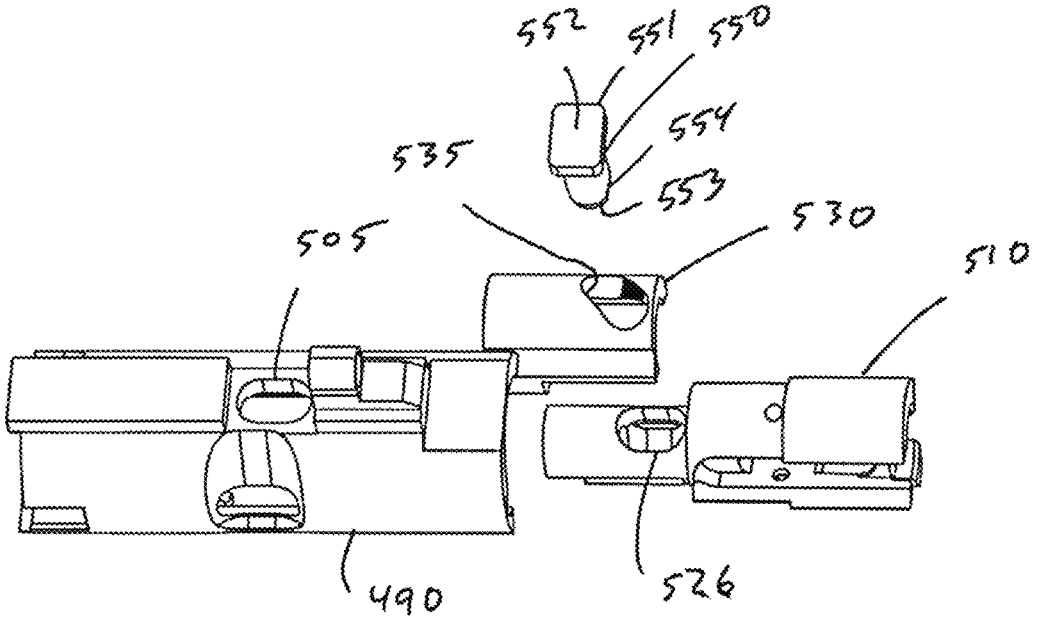
FIG. 70 is an exploded view of the bolt body, the cam rotary lock, the cam pin and the bolt.
Figure 71:
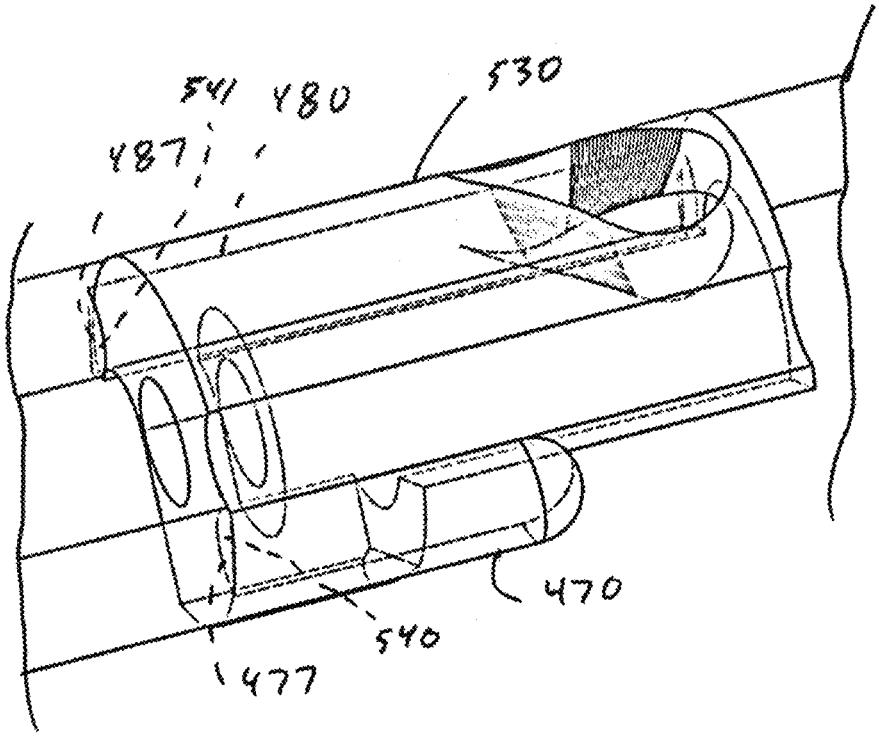
FIG. 71 is a perspective view showing an engagement of a relief wall of the rods and the end of the cam rotary lock.

Looking at FIG. 66, it is seen how the firing pin 560 passes through the cap pin end passage 554. This holds the cam pin 550 in position wherein it passes through slot 526 of the bolt 510, slot 535 of the cam rotary lock 530 and slot 505 of the bolt body.

Rod 470 is inserted in to rod hole 496 of the bolt body 490. The relief 476 allows the end edge of the rod clear the lock section 540 of the cam rotary lock 530. The forward end of the rod 470 slidably passes along rod sidewall 501 of the bolt body 490. The rod wall 477 at the rear end of the relief 476 engages the lock section 540 on the cam rotary lock when the cam pin 550 is at a first end of slot 535.

Rod 480 is inserted into rod hole 497 of the bolt body 490. The relief 486 allows the end edge of the rod clear the lock section 510 of the cam rotary lock 530. The forward end of the rod 480 slidably passes along rod sidewall 502 of the bolt body 490. The rod wall 487 at the rear end of the relief 486 engages the lock section 541 on the cam rotary lock when the cam pin 550 is at a first end of slot 535.

An internal spring biases the bolt 510 forward in relation to the bolt body 490 so that the rear end of the slot 526 abuts the cam pin 550. The bolt is slid rearward in the bolt body 490 until it abuts the cam rotary lock 530 when positioned in battery. In this position, the bolt is locked.

During detonation, the expanding gasses press against the bolt 510, which in turn presses against the cam rotary lock 530, which is held in place by abutting engagement between rod walls 477 and 487 and lock sections 540 and 541, respectively.

Then, due to inertia, the bolt body 490 moves rearward towards the base plate 430. The cam pin 550 first moves from the rear end to the front end of slot 505. When the front end of the slot 550 abuts the cam pin 550, it pulls the cam pin along with it. This forces the cam pin to move within slot 535 of the cam rotary lock 530. The cam rotary lock twists relative to the cam pin lock longitudinal axis as the cam pin moves within the slot 535.

The wall 477 and lock section 540, and the wall 487 and lock section 541, both disengage when the rotary cam lock 530 is rotated. Once the bolt is unlocked, the bolt body 490, cam rotary lock 530 and bolt 510 can complete the reciprocation cycle. Rod 477 is received between rod passage sidewall 501 and rod sidewall 545 during reciprocation. Rod 487 is received between rod passage sidewall 502 and rod sidewall 546 during reciprocation.

Figure 72:
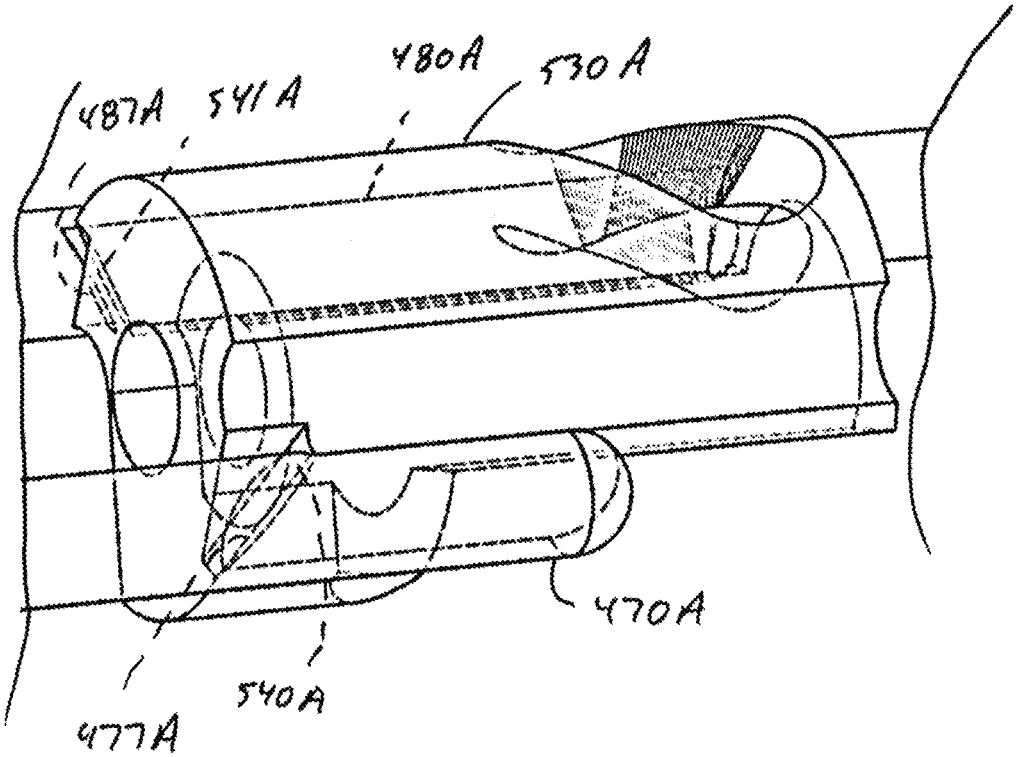
FIG. 72 is similar to FIG. 71 but shows an alternative embodiment having angled engagement faces of the cam rotary lock and recoil rod relief walls.
Figure 73:
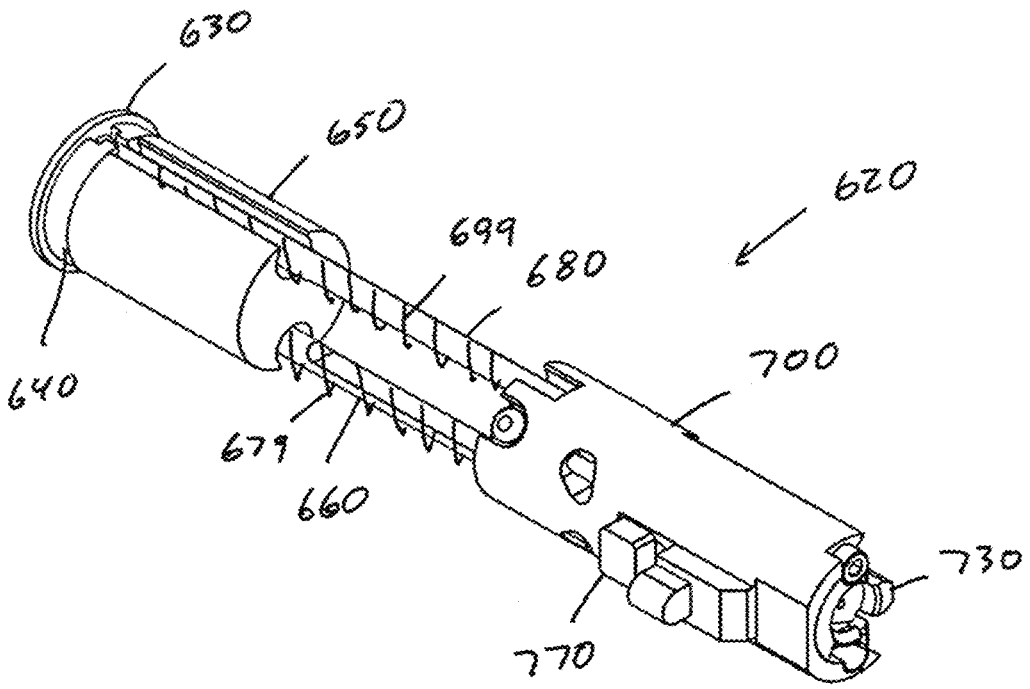
FIG. 73 is a perspective view of an alternative preferred embodiment of the present invention.
Figure 74:
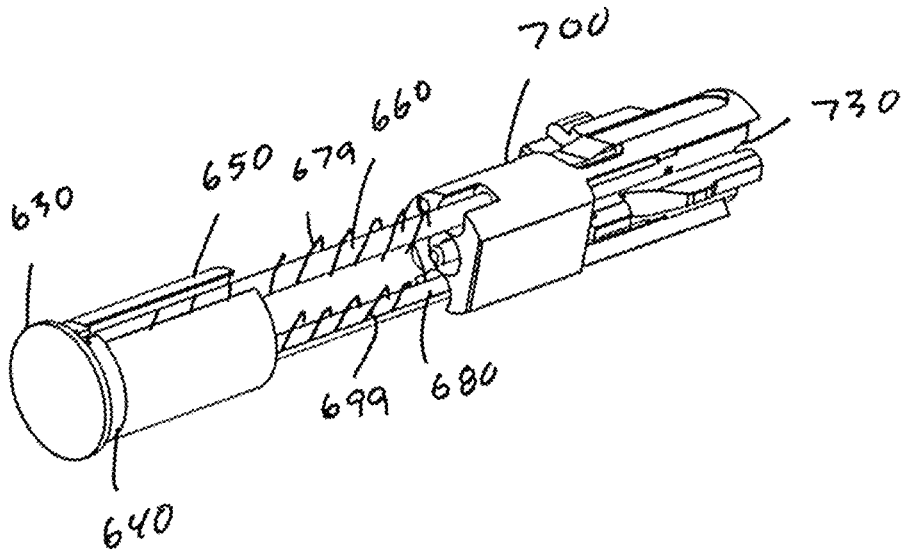
FIG. 74 is an alternative perspective view of the embodiment illustrated in FIG. 73.

Turning now to FIG. 72, it is seen that the wall 477A of the rod 470A is angled approximately 45 degrees (45 degree angle offset from perpendicular to the longitudinal axis). This angled wall interfaces with angled lock section 540A of cam rotary lock 530A. Wall 487A of rod 480A is also angled about 45 degrees (45 degree angle offset from perpendicular to the longitudinal axis). This angled wall interfaces with angled lock section 541A of cam rotary lock 530A. Varying the angle of the interface is useful in setting dwell time. In this regard, the greater the angle of the interface offset from perpendicular to the longitudinal axis, the shorter the dwell time.

It is appreciated that the angle of the interface is preferably between 0 degrees (FIGS. 71) and 45 degrees (FIG. 72).

Turning now to FIGS. 73-97, it is seen that an additional preferred embodiment of an assembly 620 is provided. the assembly 620 has a base plate 630, a rod lock 640, a rubber base 650, two recoil rods 660 and 680, a bolt body 700, a bolt 730, rollers 750 and 755, a cam pin 770 and a firing pin 780. Each of these components is described below.

The base plate 630 is illustrated in FIGS. 73-76. The bae plate 630 has a flat disc shaped portion with an outer perimeter and a post projecting from one side perpendicular to the disc shaped portion.

The rod lock 640 has a forward projection 641. The rod lock has a central hole on the back side for receiving the post 631 of the base plate. Rod lock 640 further has a first retainer 642 and a second retainer 643. The retainers are preferably diametrically opposed. The retainers are formed of a constriction within the holes that otherwise preferably have a constant profile.

The rubber base 650 has opposed ends. Rod holes 651 and 652 are formed through the rubber base 650. The holes are open to the ends and open to the outside of the base between the ends. The projection 641 is receivable within a hole in the rubber base whereby the retainer 642 is adjacent to hole 651 as the rearward end of the rubber base and the retainer 643 is adjacent to hole 652 at the rearward end of the rubber base.

Figure 75:
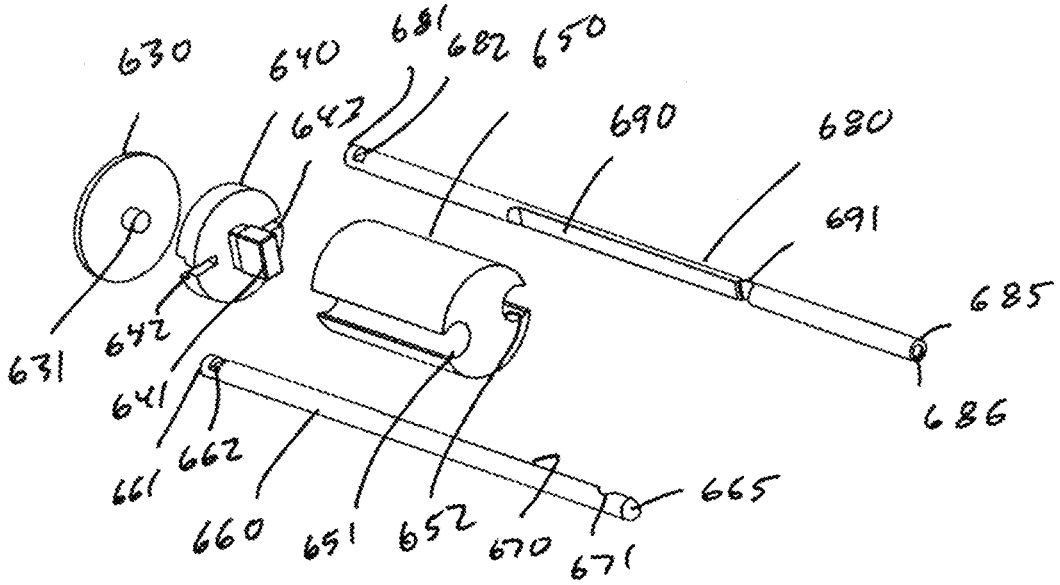
FIG. 75 is a perspective view showing a base plate, a rod lock, a rubber base, and two rods.
Figure 76:
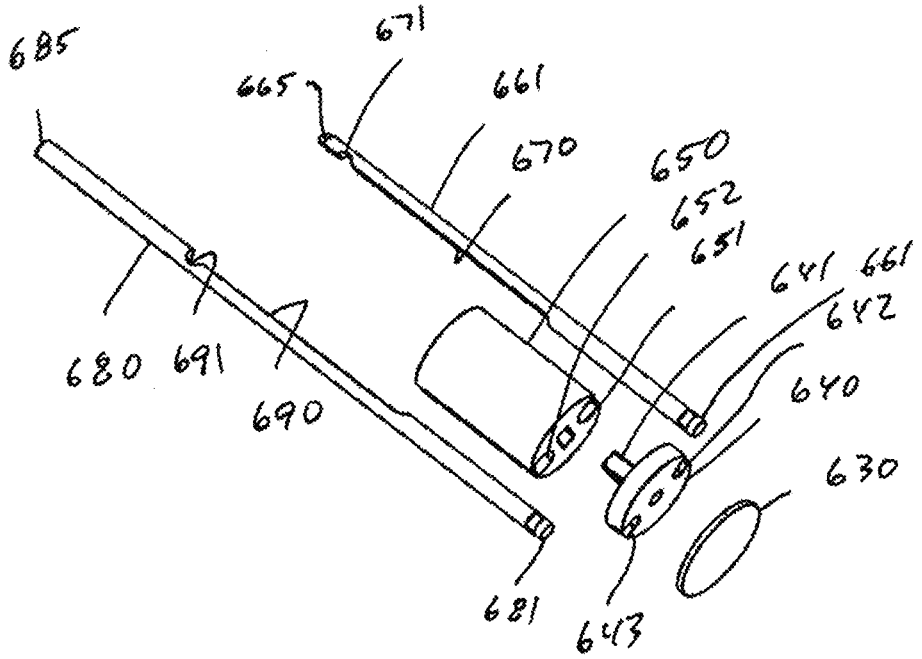
FIG. 76 is an alternative perspective view of the components illustrated in FIG. 75.
Figure 77:
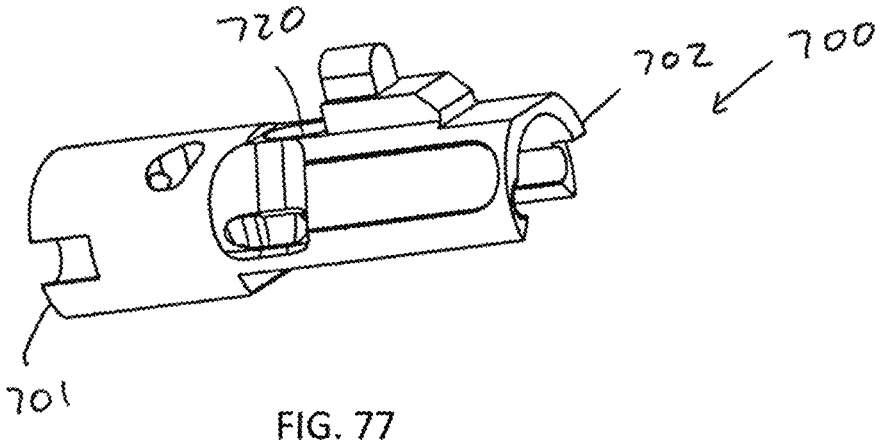
FIG. 77 is a perspective view of a bolt body of the embodiment illustrated in FIG. 73.
Figure 78:
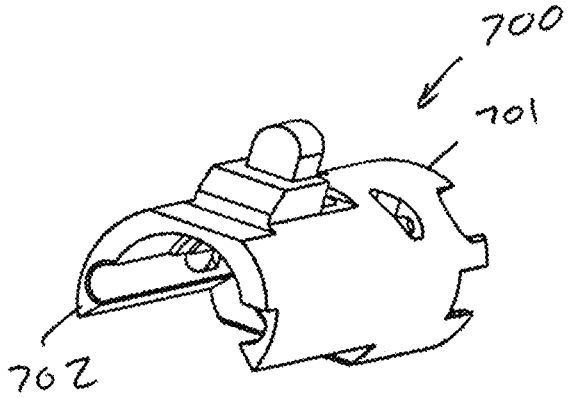
FIG. 78 is an alternative perspective view of the bolt body.
Figure 79:
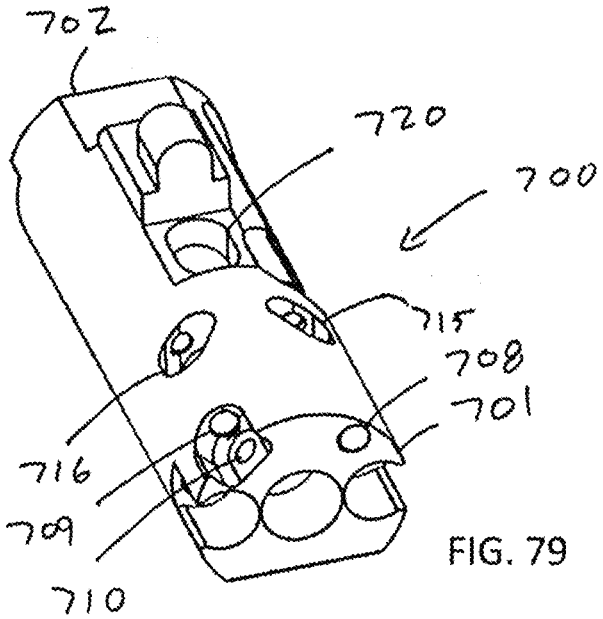
FIG. 79 is a further perspective view of the bolt body.
Figure 80:
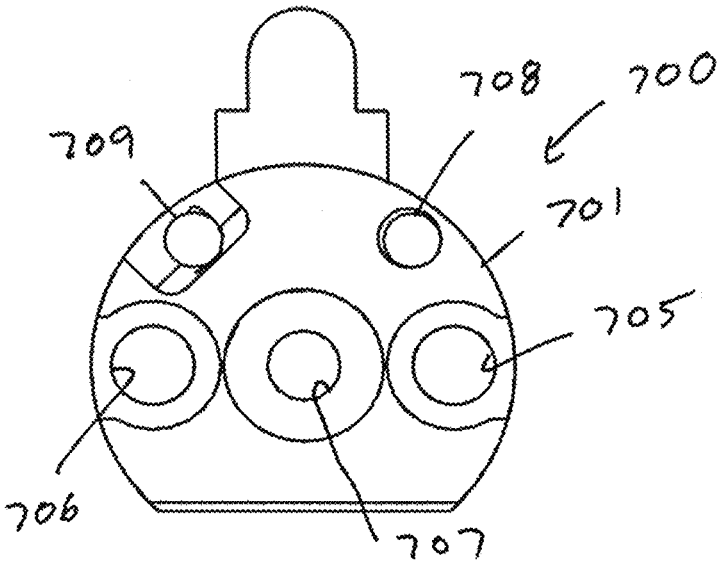
FIG. 80 is an end view of the bolt body.

Recoil rod 660 is best illustrated in FIGS. 75 and 76. Rod 660 has an end 661 with notches 662 near the end. The notches 662 allow the rod 670 to be laterally received within the rod lock 640 at the retainer 642, wherein the retainer 642 prevents longitudinal movement of the rod relative to the rod lock 640. The rod 660 also has a second end 665. The rod has an extended relief 670 between the ends. A channel 671 is at the forward end of the relief 670. The channel 671 preferably has a semicircular profile and is oriented perpendicular to a rod longitudinal axis. A spring 679 preferably surrounds the rod 660. In this regard, the spring is compressed during the blowback and the expands to move the bolt forward to complete the reciprocation.

Recoil rod 680 is best illustrated in FIGS. 75 and 76. Rod 680 has an end 681 with notches 682 near the end. The notches 682 allow the rod 680 to be laterally received within the rod lock 640 at the retainer 643, wherein the retainer 643 prevents longitudinal movement of the rod relative to the rod lock 640. The rod 680 also has a second end 685. A screw hole 686 is provided at the end 665 for receiving a screw or fastener that can act as a stop to prevent unintentional disassembly of the assembly. The rod has an extended relief 690 between the ends. A channel 691 is at the forward end of the relief 690. The channel 691 preferably has a semicircular profile and is oriented perpendicular to a rod longitudinal axis. A spring 699 preferably surrounds the rod 680. In this regard, the spring is compressed during the blowback and the expands to move the bolt forward to complete the reciprocation.

It is appreciated that while two recoil rods are illustrated, that there could be more or fewer recoil rods without departing from the broad aspects of the present invention. It is also appreciated that each rod does not need to have a spring around it. It is further appreciated that a recoil spring does not need to surround a rod.

Figure 81:
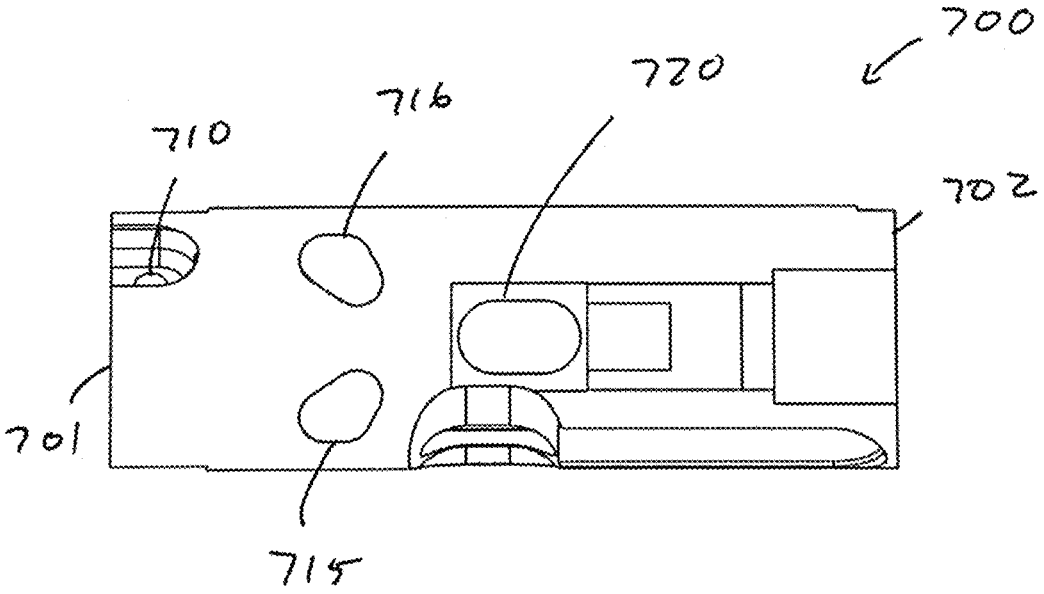
FIG. 81 is a top view of the bolt body.

The bolt body 700 is illustrated in FIGS. 77-81. The bolt body 700 has ends 701 and 702. Two rod holes 705 and 706, respectively, are formed longitudinally through the bolt body 700. The bolt body 700 further has a firing pin hole 707, a roller retainer hole 708, a roller retainer hole 709, a firing pin retainer hole 710, a roller slot 715, a roller slot 716 and a cam slot 720. Rod holes 705 and 706 are preferably parallel to each other. The firing pin hole 707 is preferably centrally aligned on the bolt body 700 and has an axis parallel with the bolt body longitudinal axis. The roller retaining holes 708 and 709 are open to the rear end of the bolt body. Roller slots 715 and 716 have a rounded outer edge profile (as best illustrated in FIG. 81). The cam slot 720 is preferably linear with a slot axis that is generally parallel to the bolt body longitudinal axis.

Figure 82:
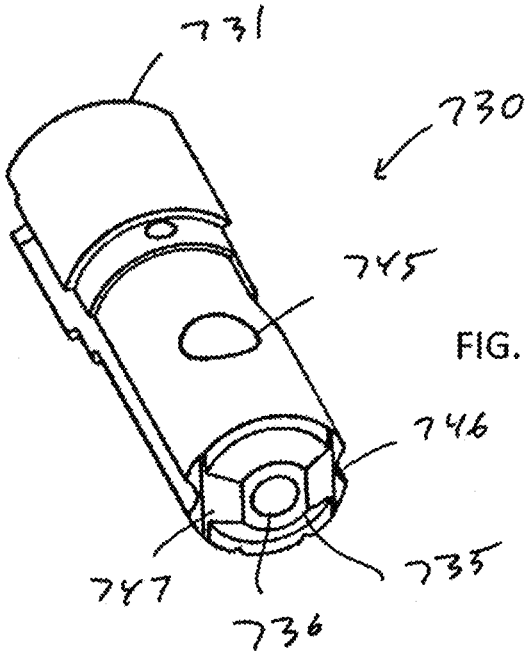
FIG. 82 is a perspective view of the bolt of the embodiment illustrated in FIG. 73.
Figure 83:
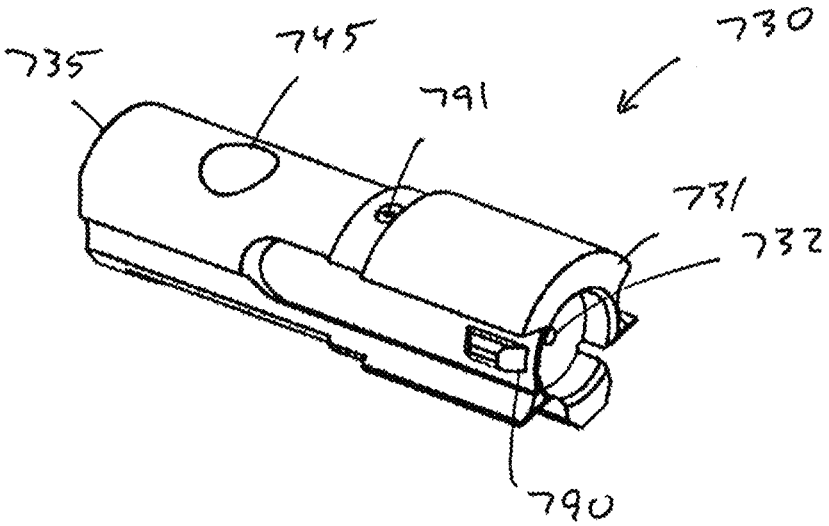
FIG. 83 is an alternative perspective view of the bolt.
Figure 84:
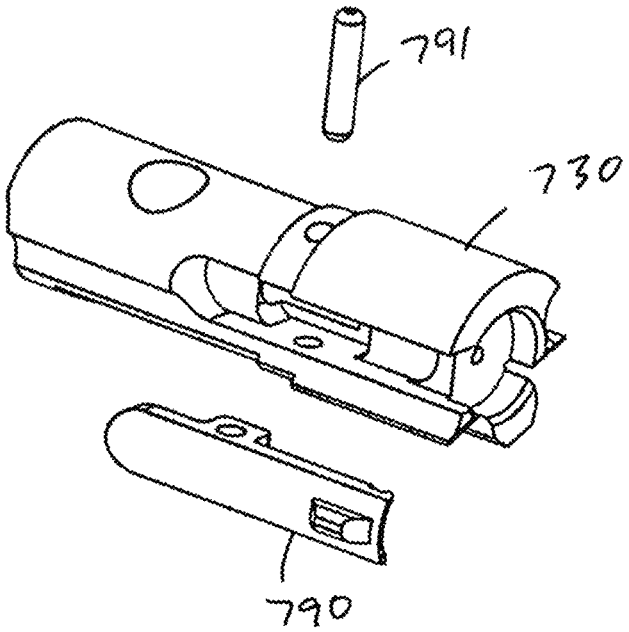
FIG. 84 is a perspective exploded view of the bolt and the extractor.

The bolt 730 is illustrated in FIGS. 82-84. The bolt has an end 731 with a firing pin hole 732 therethrough. The bolt 730 further has an opposed end 735 with a firing pin hole 736 therethrough. An extractor pocket 740 is provided at end 735. The extractor pocket pivotally receives an extractor 790. An extractor pin 791 pivotally holds the extractor within the pocket 740. The bolt 730 further has a cam hole 745. The cam hole 745 has a shape that corresponds to the shape of a cam pin 770, which is preferably round.

Figure 85:
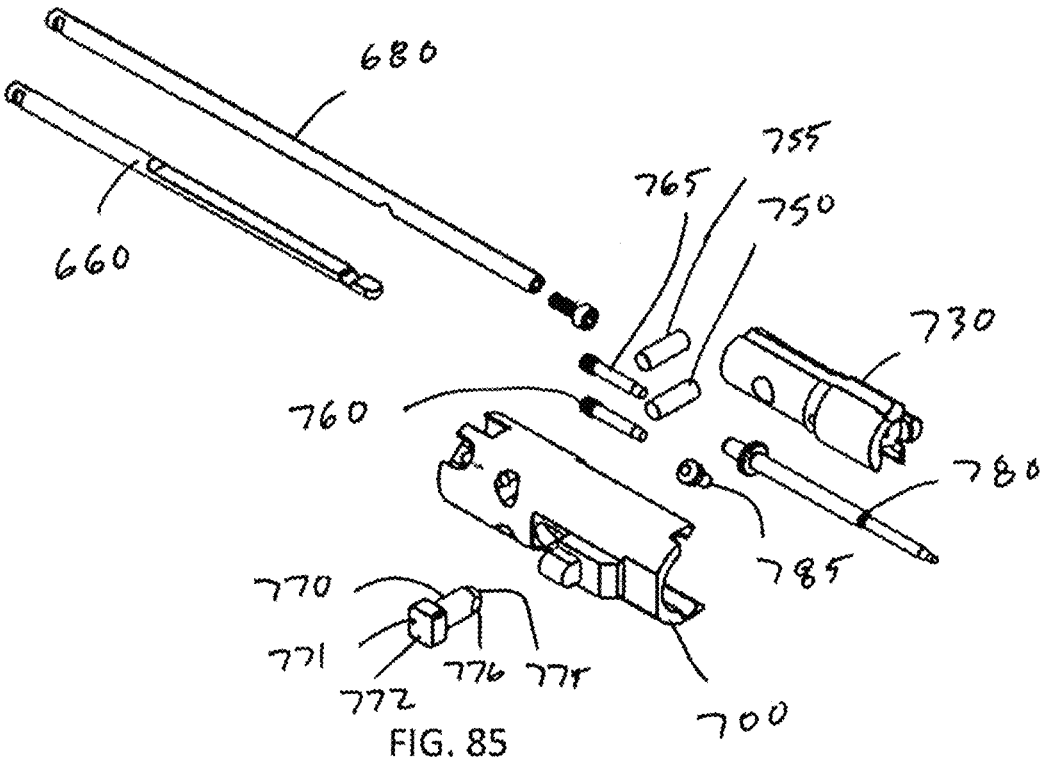
FIG. 85 is an exploded view showing the rods, bolt body, bolt, rollers and cam pin.

The cam pin 770, best seen in FIG. 85, has an end 771 and an end 775. A head is at end 771 and a passage 776 is at end 775. The cam pin passes through slot 720 in the bolt body 700 and through the cam hole 745 in the bolt 730. The firing pin 780 passes through the passage to hold the cam pin 770 in position within the slot 720 and hole 745. The firing pin retainer 785 is inserted through the firing pin retainer hole 710 to hold the firing pin in place.

End 665 of rod 660 is received within hole 705 of the bolt body. End 685 of rod 680 is received within hole 706 of the bolt body. Each rod is inserted a sufficient amount so that portions of the reliefs 670 and 690 are aligned the roller slots 715 and 716.

Roller 750 is received within the bolt body 700 in roller slot 715. The roller passes in the relief 670 of rod 660. The roller retainer 760 is inserted through roller retainer hole 708 to retain the roller in position.

Roller 755 is received within the bolt body 700 in roller slot 716. The roller passes in the relief 690 of rod 680. The roller retainer 765 is inserted through roller retainer hole 709 to retain the roller in position.

Figure 86:
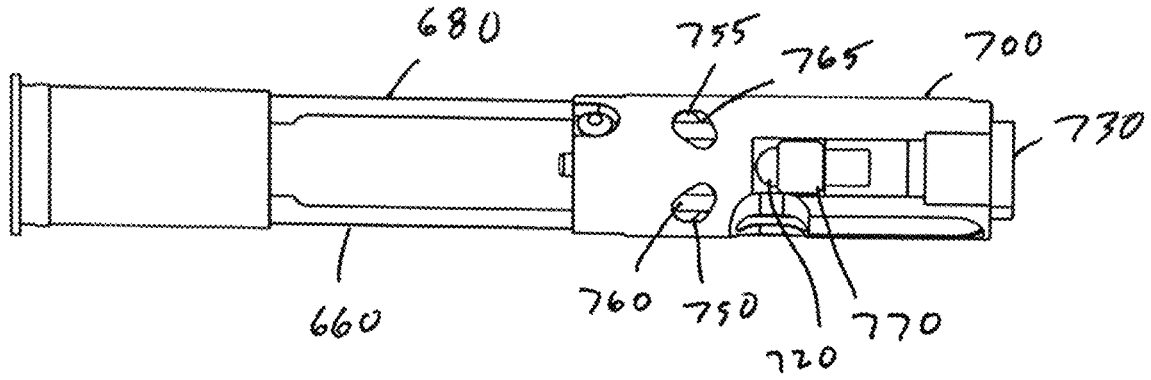
FIG. 86 is a top view of the embodiment illustrated in FIG. 73.
Figure 87:
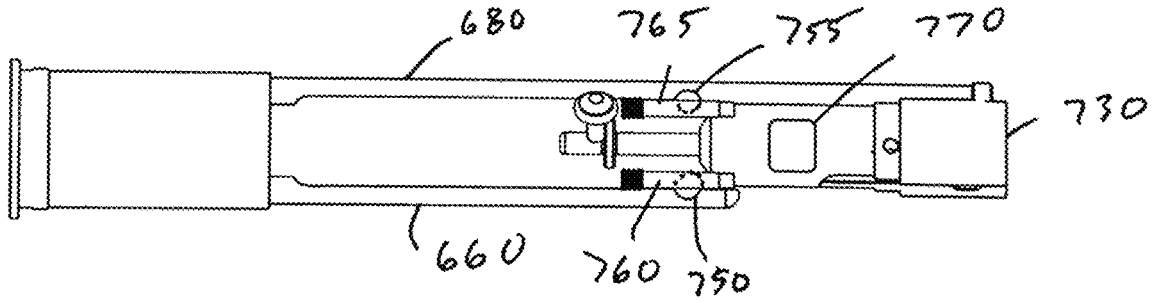
FIG. 87 is similar to FIG. 86 but is shown without the bolt body.
Figure 88:
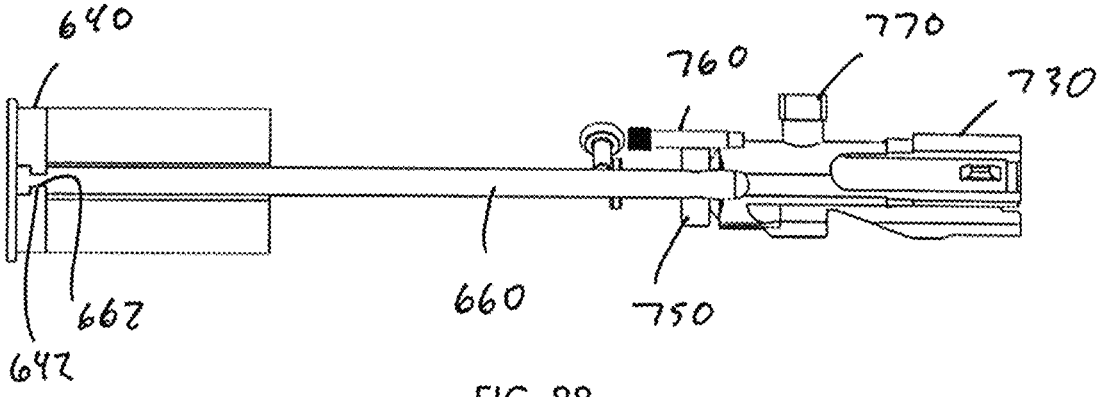
FIG. 88 is a side view of the illustration shown in FIG. 87.
Figure 89:
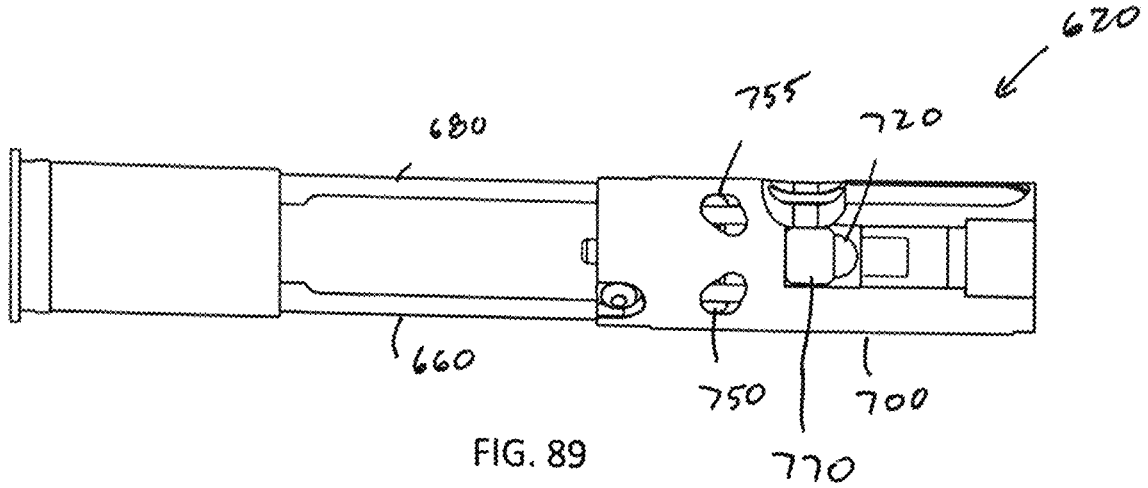
FIG. 89 is a top view of the embodiment illustrated in FIG. 73 shown with the bolt in battery.
Figure 90:
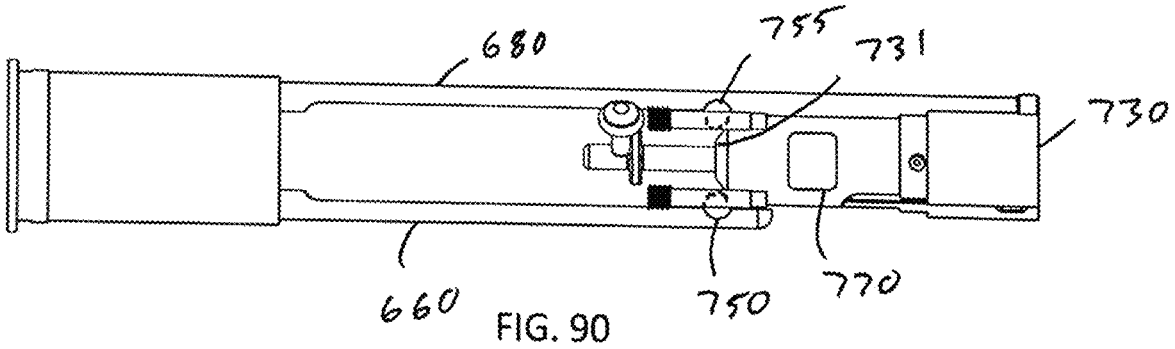
FIG. 90 is similar to FIG. 89 but is shown without the bolt body.
Figure 91:
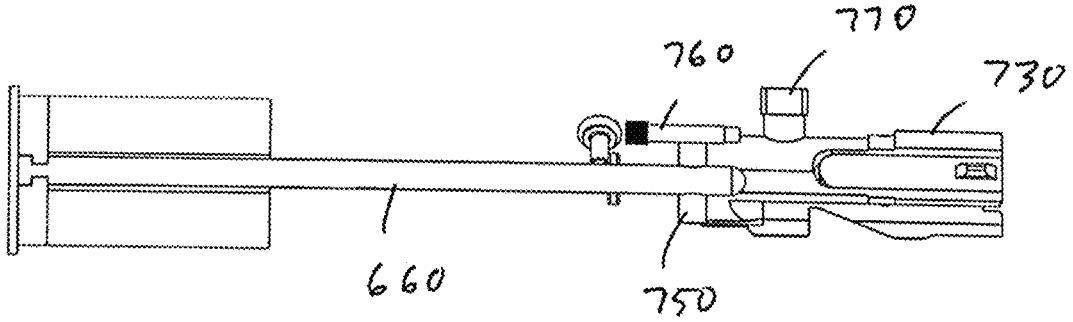
FIG. 91 is a side view of the illustration shown in FIG. 90.
Figure 92:
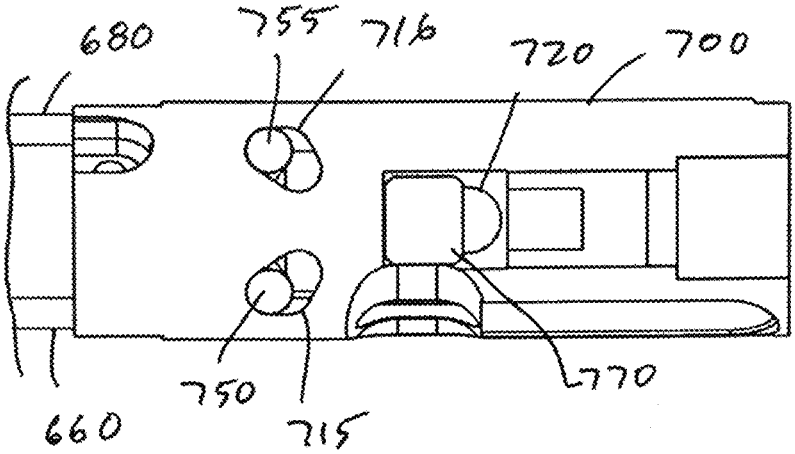
FIG. 92 is a close-up view showing the rollers at one end of slots of the bolt body and the bolt being locked.
Figure 93:
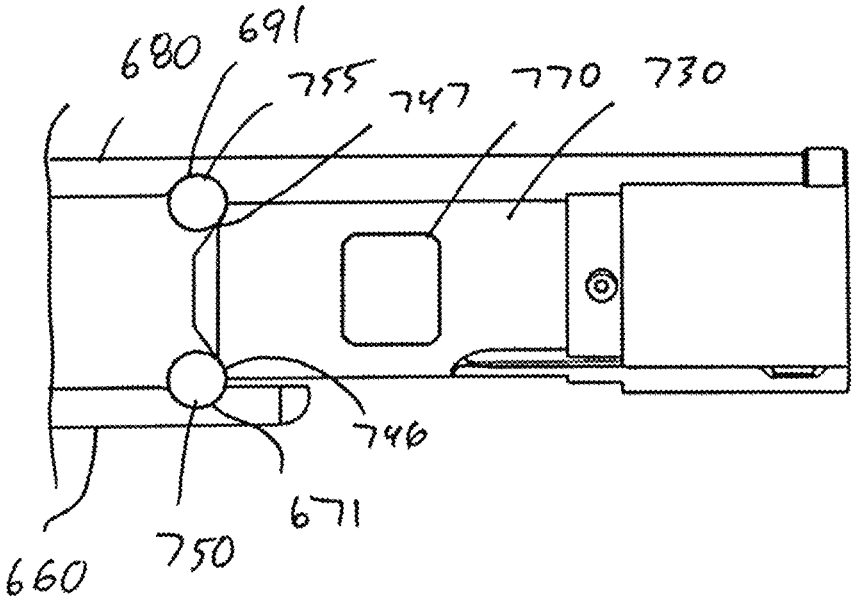
FIG. 93 shows the rollers received and channels of the rods and the bolt locked.

An internal spring biases the bolt 730 to a forward position. The forward position is illustrated in FIGS. 86-88. It is seen that the cam pin 770 is located in the forward end of slot 720.

Turning now to FIGS. 89-93, the bolt 730 is shown positioned in battery. The rollers 750 and 755 are at the rearward end of slots 715 and 716. The rear end 731 of the bolt 680 engages the rollers 750 and 755 (at engagement points 746 and 747) forcing them to remain in the channels 671 and 691, respectively. The bolt 730 is locked in this position. During detonation, the expanding gasses press upon the bolt 730 which in turn holds the rollers in the channels.

Figure 94:
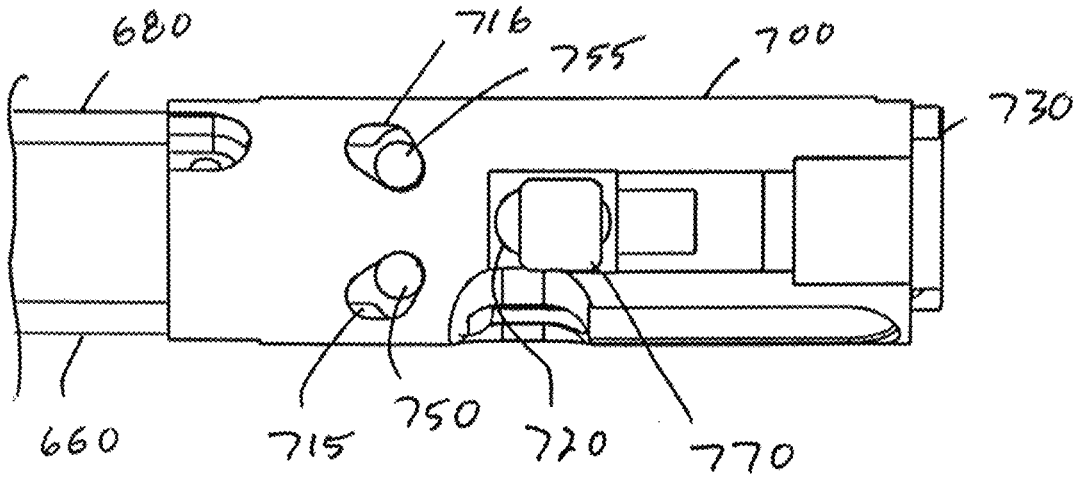
FIG. 94 is a close-up view showing the rollers move to second ends of the slots in the bolt body as the bolt body moves rearwards.
Figure 95:
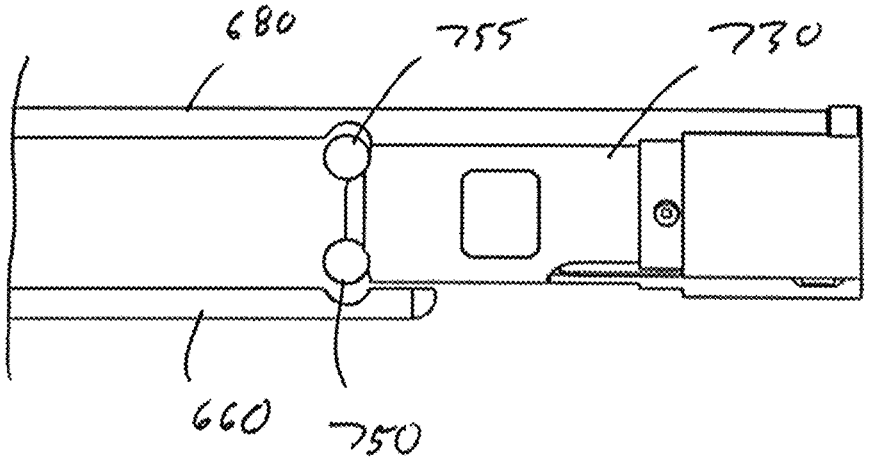
FIG. 95 is similar to FIG. 94 but is shown without the bolt body.

Then, due to inertia, the bolt body 700 moves rearward towards the rubber base 650. The cam pin moves towards the forward end of the slot 720. The bolt 730 moves with the cam pin 770 and according moves forward relative to the bolt body 700. As this occurs, the rollers 750 and 755 move within respective slots 715 and 716 to the forward positions within the slot. Doing this pulls the rollers inwards and out of the channels 671 and 691. The unlocked position is illustrated in FIGS. 94 and 95.

Figure 96:
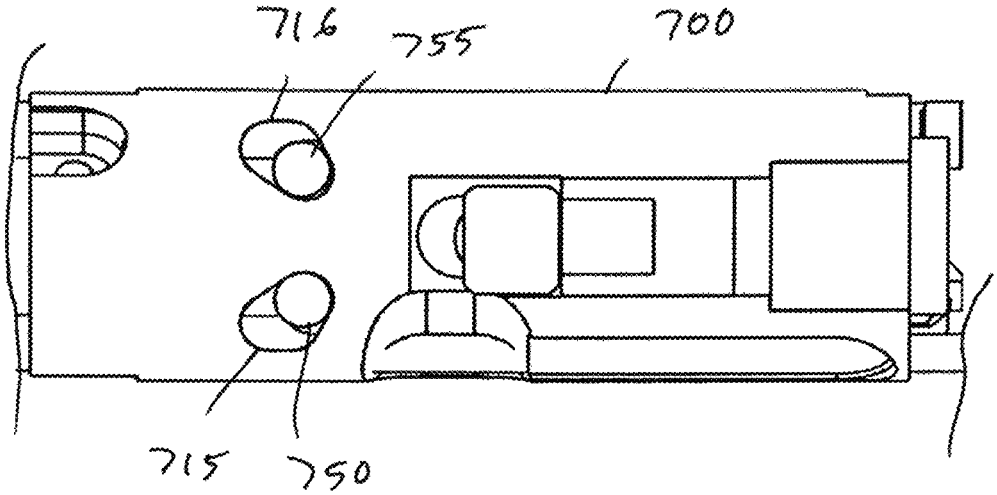
FIG. 96 is a close-up view showing component locations when the bolt is located at the rearward end of travel during reciprocation.
Figure 97:
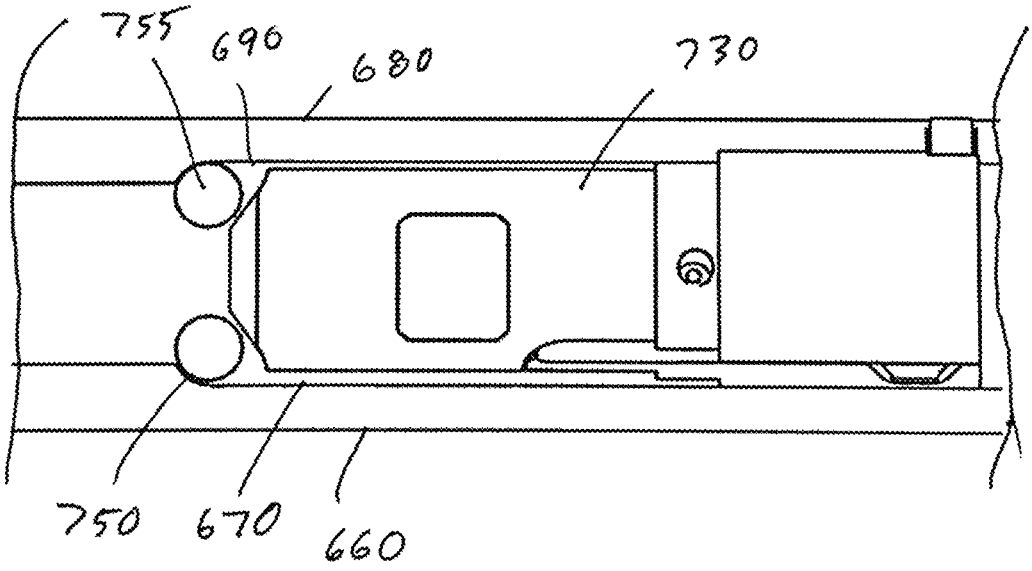
FIG. 97 is similar to FIG. 96 but is shown without the bolt body.

With the rollers 750 and 755 in inward positions, the bolt 730 and bolt body 700 can reciprocate. FIGS. 96 and 97 show the most rearward position of the bolt 730 and bolt body 700 during the reciprocation. The compresses springs around rods 660 and 680 apply forces to return the bolt 730 and bolt body 700 to their forward position.

Thus, it is apparent that there has been provided, in accordance with the invention, a self-locking bolt system that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An assembly for a firearm achieving delayed blowback, said assembly comprising:
- a bolt;
- a bolt body having a main cavity and a rod hole, said bolt being received within said main cavity;
- an additional assembly component being a rod, said rod being received within said rod hole; and
- a locking mechanism,
- wherein, when said bolt is in battery, said bolt is held in a locked position by having said locking mechanism engage said additional assembly component until said bolt is unlocked as said locking mechanism and said additional assembly component disengage by rearward motion of said bolt body after the firearm is discharged.

2. The assembly of claim 1 wherein said assembly is fully received within a receiver of the firearm.

3. The assembly of claim 1 wherein:
- said locking mechanism is a cam rotary lock; and
- said assembly further comprises a cam pin.

4. The assembly of claim 3 wherein:
- said bolt body has a bolt body slot;
- said bolt has a bolt slot;
- said cam rotary lock has a cam rotary lock slot; and
- said cam pin passes through said body bolt slot said bolt slot and said cam rotary lock slot.

5. The assembly of claim 4 wherein:
- said bolt body slot is parallel to said bolt slot; and
- said cam rotary lock slot is oriented non-parallel to said bolt body slot, wherein said cam rotary lock twists as the cam pin interfaces with the cam rotary lock slot as said bolt body moves rearward after the firearm is discharged.

6. The assembly of claim 5 wherein said rod interfaces with said cam rotary lock to lock the bolt, said cam rotary lock rotating as said bolt body travels rearward after the firearm is discharged to unlock said bolt when said rod disengages from said cam rotary lock.

7. The assembly of claim 6 wherein a locking interface is between said rod and said rotary cam lock is angled between 0 and 45 degrees.

8. An assembly for a firearm achieving delayed blowback, said assembly comprising:
- a base plate;
- a rod;
- a rod spring;
- a bolt;
- a bolt body;
- a locking mechanism; and
- a cam pin,
- wherein:
  - said rod spring is between said bolt body and said base plate;
  - said bolt is received within said bolt body; and said bolt is lockable relative to said rod in a locked position when said locking mechanism engages said rod until said bolt is unlocked by said locking mechanism and said rod disengaging by motion of said bolt body towards said base plate.

9. A method of temporarily internally locking a firearm to achieve delayed blowback, the method comprising the steps:

providing an assembly with a bolt, a bolt body, a locking mechanism and an additional assembly component being a rod, wherein the bolt is received within a main cavity of the bolt body and the additional assembly component is received within a rod hole of the bolt body;

locking the bolt when the bolt is in battery by locking the bolt with respect to the additional assembly component by having the locking assembly engage the additional assembly component;

discharging the firearm;

keeping the bolt locked until inertial movement of the bolt body unlocks the bolt.

10. The method of claim 9, wherein:

the step of providing an assembly further comprises the step of providing a relief with a relief face in the rod, providing a cam rotary lock as the locking mechanism with an angled slot, and providing a cam pin;

the step of locking the bolt further comprises the step of engaging the relief face against the cam rotary lock; and the method further comprises the step of unlocking the bolt as the rotary cam lock twists under operation of the cam pin within the angled slot.

* * * * *